US006932068B2

(12) United States Patent
Osanai

(10) Patent No.: US 6,932,068 B2
(45) Date of Patent: Aug. 23, 2005

(54) EVAPORATIVE EMISSION CONTROL SYSTEM AND METHOD

(75) Inventor: Akinori Osanai, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/859,101

(22) Filed: Jun. 3, 2004

(65) Prior Publication Data

US 2004/0250805 A1 Dec. 16, 2004

(30) Foreign Application Priority Data

Jun. 12, 2003 (JP) ..... 2003-168093

(51) Int. Cl.[7] ..... F02D 41/14; F02M 25/08

(52) U.S. Cl. ..... 123/674; 73/118.1; 123/520; 123/690; 123/698

(58) Field of Search ..... 123/198 D, 520, 123/674, 690, 698; 73/118.1; 701/109, 114

(56) References Cited

U.S. PATENT DOCUMENTS 5,295,472 A 3/1994 Otsuka et al.

5,964,811 A * 10/1999 Ishii et al. ..... 701/114

FOREIGN PATENT DOCUMENTS

| | | |
|---|---|---|
| JP | A 5-180101 | 7/1993 |
| JP | A 6-58197 | 3/1994 |
| JP | A 11-141413 | 5/1999 |

* cited by examiner

*Primary Examiner*—Tony M. Argenbright
(74) *Attorney, Agent, or Firm*—Kenyon & Kenyon

(57) ABSTRACT

An evaporative emission control system includes a canister for collecting fuel vapor from a fuel tank, and a purge control valve disposed between the canister and the intake passage of the engine. A controller of the system determines a failure of the purge control valve, executes a purging process by opening the purge control valve, executes a learning process for learning the fuel concentration of the purge gas, and executes a correcting process for correcting the amount of fuel injected into the engine based on the learned value of the fuel concentration. When the purge control valve is normal and conditions for execution of purge control are satisfied, the controller requests execution of the purging process, learning process and the correcting process. When an open failure occurs in the purge control valve, the controller always requests execution of the learning process and the correcting process.

20 Claims, 9 Drawing Sheets

VSV
CLOSED
OPEN

CCV
CLOSED
P0
KP
ΔP

PTNK
(CHECK VALVE
OPENING PRESSURE)

XVSV1
-OPEN
1
0

NE
350nm
KC1

FIG. 4A VSV

FIG. 4B CCV

FIG. 4C PTNK

FIG. 4D XVSV1 -CLOSE

EVAPORATIVE EMISSION CONTROL SYSTEM AND METHOD

INCORPORATION BY REFERENCE

The disclosure of Japanese Patent Application No. 2003-168093 filed on Jun. 12, 2003, including the specification, drawings and abstract, is incorporated herein by reference in its entirety.

BACKGROUND OF THE INVENTION

1. Field of the Invention

The invention generally relates to evaporative emission control system and method, and, more particularly, to evaporative emission control system and method in which fuel vapor collected in a canister is drawn into an intake passage of an internal combustion engine for disposal in the engine.

2. Description of Related Art

For example, an evaporative emission control system as disclosed in Japanese Laid-open Patent Publication No. 6-58197 is known which includes a canister for collecting fuel vapor generated in a fuel tank, and a purge control valve that communicates the canister with an intake passage of an internal combustion engine as needed. In this system, when the purge control valve is opened, the intake manifold vacuum is fed to the canister so that fuel vapor collected in the canister is drawn along with air into the intake passage. Thus, the known system is able to dispose of fuel vapor generated in the fuel tank without releasing the same to the atmosphere.

According to a method as disclosed in the above-identified patent publication, the system detects an open failure of the purge control valve (which occurs when the valve is stuck in the open state) and a close failure (which occurs when the purge control valve is stuck in the closed state) while distinguishing these two types of failures from each other. In this method, the system performs no special process when it detects a close failure of the purge control valve, and performs control for correcting the air/fuel ratio while stopping learning of the air/fuel ratio when it detects an open failure of the purge control valve. The air/fuel ratio correction control includes the steps of estimating the flow rate of purge gas from the engine speed and other parameter (s), and correcting the air/fuel ratio based on the estimated flow rate, as disclosed in the above-identified publication. Thus, the known control method as described above makes it possible to correct the air/fuel ratio by some degree in view of an influence of purge gas that arises from an open failure of the purge control valve, and reduce or suppress fluctuations in the air/fuel ratio in the event of the open failure.

In the known control method, when an open failure occurs in the purge control valve, learning of the air/fuel ratio is stopped, and the air/fuel ratio is corrected by using only the estimated flow rate of the purge gas as a parameter. With the air/fuel ratio corrected by using only the estimated flow rate of the purge gas as a parameter, however, the corrected air/fuel ratio does not accurately reflect changes in, for example, the fuel concentration of the purge gas. It is thus difficult for the known control method as described above to achieve highly accurate air/fuel ratio control when the purge control valve is at fault.

SUMMARY OF THE INVENTION

It is therefore an object of the invention to provide an evaporative emission control system that is able to perform highly accurate air/fuel ratio control even in the case a failure occurs in a purge control valve for controlling fluid communication between a canister and an intake passage of the engine. It is another object to provide a method of controlling an evaporative emission control system.

To accomplish the above and/or other object(s), there is provided according to one aspect of the invention an evaporative emission control system including a canister for collecting fuel vapor flowing from a fuel tank, comprising: (a) a purge control valve that controls a degree of fluid communication between the canister and an intake passage of an internal combustion engine, (b) a failure determining unit that determines a failure of the purge control valve, (c) a purging unit that executes a purging process by opening the purge control valve so that purge gas flows from the canister to the intake passage, (d) a fuel concentration learning unit that executes a learning process for learning a fuel concentration of the purge gas to provide a learned value of the fuel concentration, (e) a fuel injection amount correcting unit that executes a correcting process for correcting an amount of fuel injected into the internal combustion engine based on the learned value of the fuel concentration, (f) a purge condition determining unit that determines whether at least one condition for execution of purge control is satisfied, (g) a normal process requesting unit that requests execution of the purging process, the learning process and the correcting process when the purge control valve is normal and the at least one condition for execution of purge control is satisfied, and (h) an open-failure-mode process requesting unit that always requests execution of the learning process and the correcting process when the failure determining unit determines that an open failure occurs in the purge control valve, the open failure being detected when the purge control valve is stuck in an open state.

According to the above aspect of the invention, when it is determined that the purge control valve is normal, the system executes the purging process under a situation where the conditions for execution of purge control are satisfied. When an open failure of the purge control valve is detected, the system executes the process of learning the fuel concentration in the purge gas and the process of correcting the fuel injection amount without exception, namely, irrespective of whether or not the conditions for execution of purge control are satisfied. In the event of an open failure of the purge control valve, the purge gas constantly or continuously flows into the intake passage as long as the engine is operating. According to the above aspect of the invention, the system is able to learn the fuel concentration in the purge gas without fail, and always accurately correct the fuel injection amount based on the learned value of the fuel concentration. Thus, the system of the invention is able to achieve highly accurate air/fuel ratio control even in the event of an open failure of the purge control valve.

In one embodiment of the above aspect of the invention, the evaporative emission control system further includes (1) a calculating method learning unit that executes a calculation method learning process for learning a calculating method of the fuel injection amount so as to provide an air/fuel ratio that is substantially equal to a target air/fuel ratio, (2) a normal-mode learning requesting unit that requests execution of the calculation method learning process when the purge control valve is normal and the purge control valve is in a closed state, and (3) a close-failure-mode learning requesting unit that always requests execution of the calculation method learning process when the failure determining unit determines that a close failure occurs in the purge control valve, the close failure being detected when the purge control valve is stuck in a closed state.

In the embodiment as described above, when a close failure of the purge control valve is detected, the system is always requested to learn the calculation method of the fuel injection amount on the assumption that no purge gas is present. Thus, the system of this embodiment is able to achieve highly accurate air/fuel ratio control in the event of a close failure of the purge control valve. Also, when it is determined that the purge control valve is normal and the purge control valve is placed in the closed state, the system can request learning of the calculation method of the fuel injection amount. In this case, since the calculation method of the fuel injection amount can be learned only under the situation where no purge gas is present in the system, erroneous learning is not performed, and the system is able to achieve highly accurate air/fuel ratio control on all occasions.

In another embodiment of the invention, the fuel injection amount correcting unit calculates a correction amount of the fuel injection amount based on an opening angle of the purge control valve and the learned value of the fuel concentration of the purge gas, and the fuel concentration learning unit learns the fuel concentration of the purge gas so as to provide a target air/fuel ratio when the fuel injection amount is corrected by the calculated correction amount, while the system further includes an open-failure-mode opening angle setting unit that sets the opening angle of the purge control valve to a fixed value that is not equal to zero in the event of the open failure of the purge control valve.

In the embodiment as described just above, when an open failure occurs in the purge control valve, the opening angle of the purge control valve can be set to a certain fixed value that is not equal to zero. In the event of an open failure of the purge control valve, the opening angle of the purge control valve is most likely to be a constant value, and purge gas flows into the intake passage in an amount commensurate with the constant opening angle. In this case, the system corrects the fuel injection amount on the assumption that the opening angle of the purge control valve is constant, and learns the fuel concentration in the purge gas so that the target air/fuel ratio is achieved when the fuel injection amount is corrected in this manner. If the fuel concentration is learned on the assumption that the opening angle of the purge control valve is varying in spite of the fact that the opening angle is fixed, the learned value of the fuel concentration keeps fluctuating and does not become a constant value. According to the method as described above, on the other hand, the learned value of the fuel concentration ultimately becomes a constant value. Thus, the system as described just above can achieve highly accurate air/fuel ratio control in the event of an open failure of the purge control valve.

In the embodiment as described above, the fixed value may be set as a value equivalent to an opening angle of the purge control valve that is in a fully open state. In this case, the system is able to perform learning of the fuel concentration and correction of the fuel injection amount on the assumption that the purge control valve is in the fully open state, in the event of an open failure of the purge control valve. In many cases, the purge control valve is fully opened when an open failure occurs. Thus, the system is able to perform air/fuel ratio control with high accuracy, by a method that is most suitable for the actual situation in the event of an open failure of the purge control valve.

In a further embodiment of the invention, the evaporative emission control system further includes (1) a shut-off mechanism that shuts off the canister from the atmosphere when the internal combustion engine is started, (2) a purge control valve control unit that places the purge control valve in a closed state when the engine is started, (3) a pressure change calculating unit that calculates a pressure change that arises in a system including the canister over a predetermined period after the engine is started, (4) an open failure determining unit that determines the open failure of the purge control valve based on the pressure change, (5) a temperature environment sensing unit that senses a temperature environment of the fuel tank when the engine is started, and (6) a determination permitting unit that permits determination of the open failure based on the pressure change only when the temperature environment of the fuel tank is in a low temperature range that is lower than a predetermined temperature.

In the embodiment as described just above, the presence or the absence of an open failure of the purge control valve can be determined on the basis of a pressure change in the system including the canister when the engine is started. According to this embodiment, the failure determination is permitted only in a low-temperature environment where the pressure change is less or not likely to be influenced by fuel vapor generated in the fuel tank, and therefore the determination can be made with high reliability.

In a still another embodiment of the invention, the evaporative emission control system further includes (1) a shut-off mechanism that shuts off the canister from the atmosphere when the internal combustion engine is started, (2) a purge control valve control unit that places the purge control valve in an open state when the engine is started, (3) a pressure change calculating unit that calculates a pressure change that arises in a system including the canister over a predetermined period after the engine is started, (4) a close failure determining unit that determines the close failure of the purge control valve based on the pressure change, (5) a temperature environment sensing unit that senses a temperature environment of the fuel tank when the engine is started, and (6) a determination permitting unit that permits determination of the close failure based on the pressure change only when the temperature environment of the fuel tank is in a low temperature range that is lower than a predetermined temperature.

In the embodiment as described just above, the presence or the absence of a close failure of the purge control valve can be determined on the basis of a pressure change in the system including the canister when the engine is started. According to this embodiment, the failure determination is permitted only in a low-temperature environment where the pressure change is less or not likely to be influenced by fuel vapor generated in the fuel tank, and therefore the determination can be made with high reliability.

BRIEF DESCRIPTION OF THE DRAWINGS

The foregoing and/or further objects, features and advantages of the invention will become more apparent from the following description of exemplary embodiments with reference to the accompanying drawings, in which like numerals are used to represent like elements and wherein.

DETAILED DESCRIPTION OF EXEMPLARY EMBODIMENTS

Figure 1:
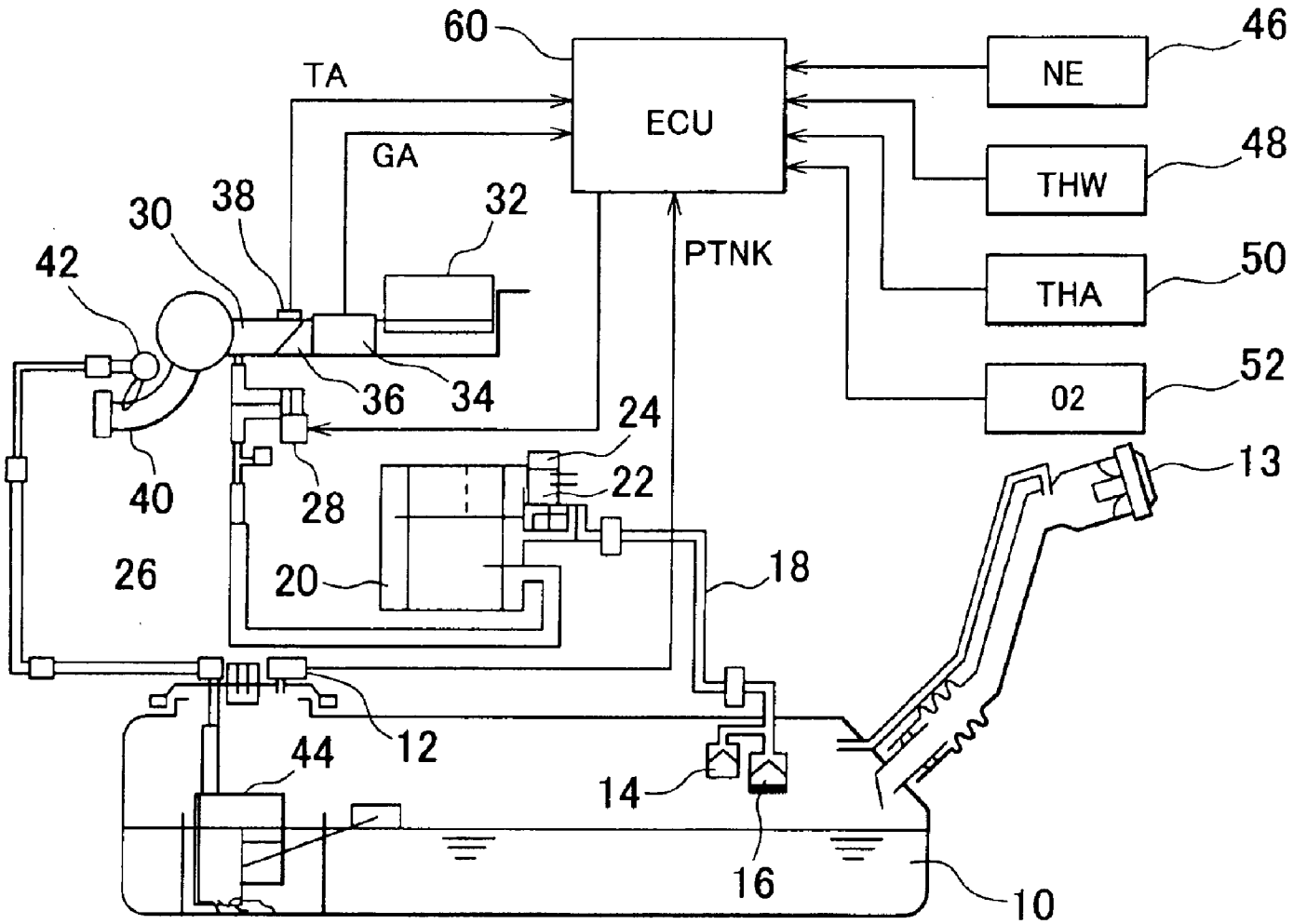
FIG. 1 is a view showing the construction of an evaporative emission control system according to a first embodiment of the invention.

Some exemplary embodiments of the invention will be described in detail with reference to the drawings, in which the same reference numerals or symbols are used for identifying corresponding elements or steps of which detailed explanation will not be repeated.

First Embodiment

FIG. 1 shows the construction of an evaporative emission control system according to the first embodiment of the invention. The evaporative emission control system of this embodiment includes a fuel tank 10. The fuel tank 10 is provided with a tank pressure sensor 12 for measuring the pressure (tank pressure) PTNK in the fuel tank 10. A filler cap closing a filler opening of the fuel tank 10 is provided with a check valve 13 that only allows flow of gas from the outside of the fuel tank 10 to the inside thereof. To the fuel tank 10 is connected one end of a vapor conduit 18 via roll over valves (ROV) 14, 16.

The other end of the vapor conduit 18 is connected to a canister 20. The canister 20 contains activated carbon, which adsorbs fuel vapors flowing from the fuel tank 10 through the vapor conduit 18. The canister 20 is provided with an atmospheric vent, in which a canister closed valve (CCV) 22 and a check valve 24 are disposed. The CCV 22 is a normally closed solenoid-operated valve that is opened when it receives a drive signal. The check valve 24 is a one-way valve that only allows flow of fluid from the atmosphere to the inside of the canister 20.

To the canister 20 is also connected one end of a purge conduit 26. A purge vacuum switching valve (which may be called "purge VSV") 28 for controlling the flow rate of gas flowing through the purge conduit 26 is disposed at some midpoint in the purge conduit 26. The purge VSV 28 is a control valve adapted to be driven at a certain duty ratio to provide an opening angle that is substantially commensurate with the duty ratio.

The other end of the purge conduit 26 is connected to an intake passage 30 of the internal combustion engine. An air cleaner 32 is provided in an end portion of the intake passage 30. An airflow meter 34 that generates an output signal indicative of the air mass flow (i.e., flow rate or specific volume of intake air) GA is disposed downstream of the air cleaner 32. Furthermore, a throttle valve 36 for controlling the air mass flow GA is disposed downstream of the airflow meter 34. A throttle sensor 38 that generates an output signal indicative of the throttle opening TA is disposed in the vicinity of the throttle valve 36. The purge conduit 26 as described above is communicated to a certain point of the intake passage 30 downstream of the throttle valve 36.

The intake passage 30 communicates with the internal combustion engine (not shown) via an intake manifold 40. A fuel injector 42 for injecting fuel into the engine is disposed in each branch pipe of the intake manifold 40. In operation, fuel is supplied under a certain pressure from a fuel feed pump 44 disposed within the fuel tank 10 to the fuel injector 42. A fuel injection valve of the fuel injector 42 is opened in response to a valve opening signal, to eject fuel in an amount proportional to the valve opening duration. Thus, the amount of fuel injected into the engine can be controlled by varying the valve opening duration (which may be called "fuel injection time TAU") of the fuel injector 42.

The internal combustion engine incorporates various sensors, such as an engine speed sensor 46, a water temperature sensor 48, an intake air temperature sensor 50 and an oxygen sensor 52. The engine speed sensor 46 generates an output signal indicative of the engine speed NE. The water temperature sensor 48 generates an output signal indicative of the coolant temperature THW of the engine. The intake air temperature 50 generates an output signal indicative of the temperature of intake air flowing in the intake passage 30. The oxygen sensor 52 is disposed in an exhaust passage of the engine, and generates an output signal that indicates whether exhaust gas flowing into a catalyst (not shown) is lean (i.e., contains oxygen) or rich (i.e., contains no oxygen).

The system of the present embodiment has an electronic control unit (ECU) 60. Various sensors including those as indicated above and actuators are connected to the ECU 60. The ECU 60 performs various calculations or computing based on the outputs of these sensors, and executes control of the CCV 22, purge VSV 28, fuel injectors 42, and so on.

Operations of the System

1. Basic Operations

In the system of the present embodiment, the CCV 22 is held in an open state and the purge VSV 28 is held in a closed state while the engine is stopped and while refueling is conducted. Immediately after the engine is stopped, for example, a large amount of fuel vapor may be generated within the fuel tank 10 due to remaining heat. In this situation, it is necessary to cause gas containing fuel vapors to flow out of the fuel tank 10 in order to prevent the tank pressure PTNK from being elevated to an excessively high level. During refueling, the volume of the empty space in the tank is reduced as fuel flows into the fuel tank 10. In this situation, it is necessary to permit gas in the fuel tank 10 to be pushed out of the tank 10 so as to facilitate refueling.

In the above-described situations, the system of the present embodiment allows the gas in the fuel tank 10 to pass through the canister 20 and escape to the atmosphere via the CCV 22. At this time, the fuel vapors contained in the gas are adsorbed by activated carbon in the canister 20, and therefore only the air flows out through the CCV 22. Thus, the system of the present embodiment is able to effectively inhibit fuel vapor from escaping to the atmosphere while the engine is stopped or during refueling.

In the system of the present embodiment, while the engine is operating, the CCV 22 is basically held in an open state, and the purge VSV 28 is driven as needed at a certain duty ratio. If the purge VSV 28 is opened during an operation of the engine, the intake manifold vacuum is drawn to the canister 20 through the purge conduit 26. If the CCV 22 is open at this time, the air flows into the canister 20 through the CCV 22, and the canister 20 is purged of the fuel vapor collected therein due to the flow of the air. The resulting purge gas is drawn into the intake passage 30, to be ultimately combusted in the engine. Thus, the system of the present embodiment is able to suitably purge the canister 20 during operations of the engine without allowing the fuel vapor to escape to the atmosphere.

2. Determination of Open Failure of Purge VSV

The system as shown in FIG. 1 fails to perform its normal functions if a failure occurs in the purge VSV 28. As typical types of failures in the purge VSV 28, a so-called open failure occurs in the purge VSV 28 when the valve 28 is stuck in an open state or position, and a so-called close failure occurs in the purge VSV 28 when the valve 28 is stuck in a closed state or position. In order to minimize the influence of a failure of the purge VSV 28, it is desirable to detect occurrence of the failure early, and determine whether the failure is an open failure or a close failure. To this end, the system of the present embodiment successively performs diagnosis for detecting an open failure of the purge VSV 28 and diagnosis for detecting a close failure of the purge VSV 28 immediately after a start of the engine.

Figures 2A, 2B, 2C, 2D, 2E:
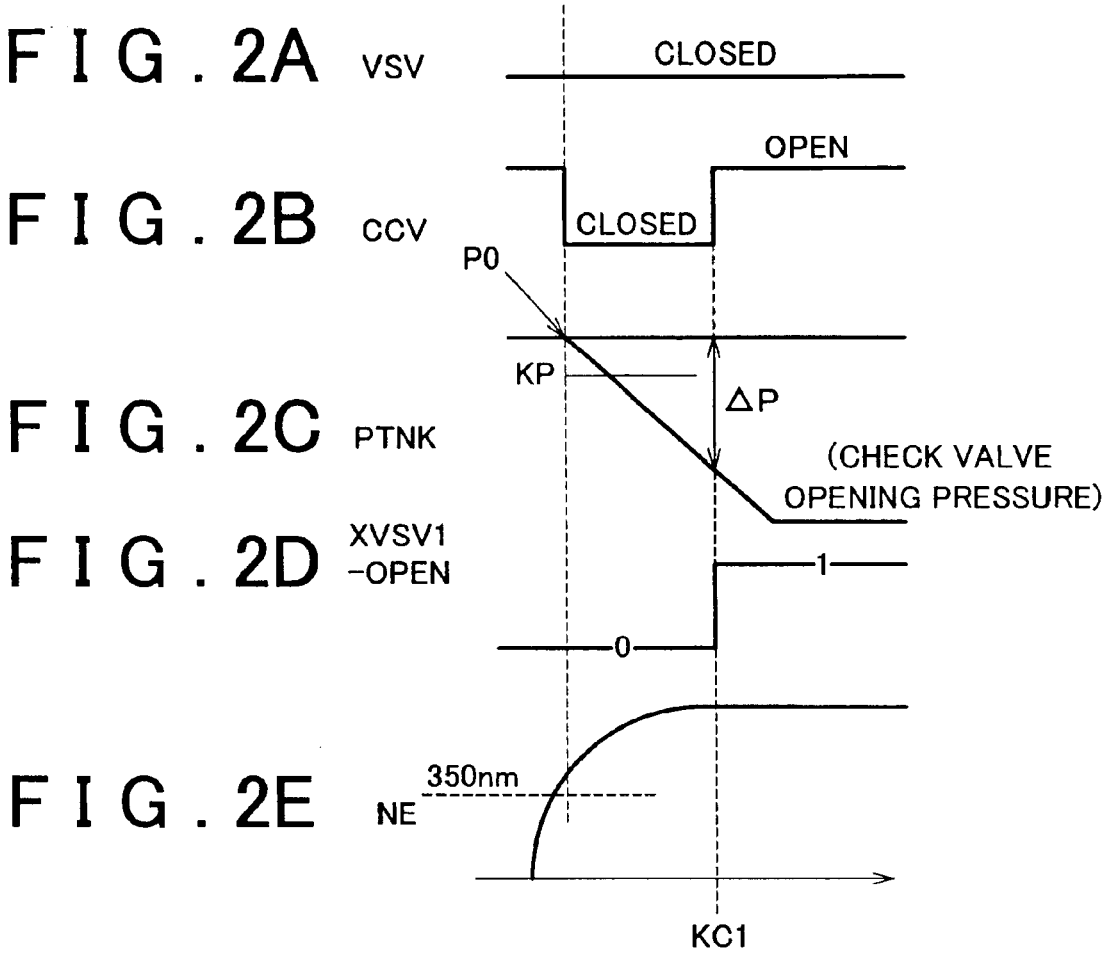
FIGS. 2A–2E is a timing chart explaining the content of a process performed by the system of the first embodiment of the invention for detecting an open failure of a purge VSV.

FIGS. 2A–2E is a timing chart explaining the content of a process for detecting an open failure of the purge VSV 28. More specifically, FIG. 2A indicates the state of the purge VSV 28 immediately after a start of the engine. As shown in FIG. 2A, the purge VSV 28 is controlled to be constantly held in the closed state during detection of an open failure. FIG. 2B and FIG. 2E indicate the state of the CCV 22 and changes in the engine speed NE, respectively, immediately after the start of the engine. As shown in these figures, the CCV 22 is kept in the open state until the engine speed NE reaches 350 rpm, namely, until complete combustion is recognized in the engine, and is brought into the closed state at a point of time when complete combustion is recognized.

FIG. 2C indicates changes in the tank pressure PTNK immediately after the start of the engine. In particular, the pattern shown in FIG. 2C appears when an open failure occurs in the purge VSV 28. In FIG. 2C, P0 represents tank pressure PTNK measured under a situation where the CCV 22 is open, and substantially means the atmospheric pressure. Also, ΔP shown in FIG. 2C means a pressure difference between PTNK and P1 which appears at a point in time when a predetermined time KC1 (FIG. 2E) has passed since the engine started. KP shown in FIG. 2C is a determination value used for determining the presence or the absence of an open failure.

An intake manifold vacuum develops in the intake passage 30 in accordance with a start of the engine. If the purge VSV 28 is properly closed as shown in FIG. 2A, the intake manifold vacuum has no influence on the tank pressure PTNK. If no open failure occurs in the purge VSV 28, therefore, the tank pressure PTNK should be kept in the vicinity of P1 after the start of the engine. If an open failure occurs in the purge VSV 28, on the other hand, the intake manifold vacuum passes the purge VSV 28 and reaches the canister 20. Since the CCV 22 is closed after complete combustion at the engine, the intake manifold vacuum passes the canister 20 and reaches the fuel tank 10. As a result, the tank pressure PTNK changes as shown in FIG. 2C. Namely, in the event of an open failure of the purge VSV 28, the tank pressure PTNK is reduced down to the valve opening pressure of the check valve 13 at which the check valve 13 opens (or a pressure corresponding to the valve opening pressure of the check valve 24) after the engine is started. Thus, the system of the present embodiment is able to determine the presence or the absence of an open failure of the purge VSV 28 by, in principle, determining whether a large pressure difference ΔP arises after the start of the engine.

FIG. 2D indicates the state of an open failure determination flag XVSV-OPEN that indicates whether an open failure occurs in the purge VSV 28. In the example of FIGS. 2A–2E, the pressure difference ΔP that is below the determination value KP is recognized at the time point when the predetermined time KC1 has passed since the start of the engine. In this case, 1 is set to the open failure determination flag XVSV-OPEN at the time point KC1 as shown in FIG. 2D.

Figure 3:
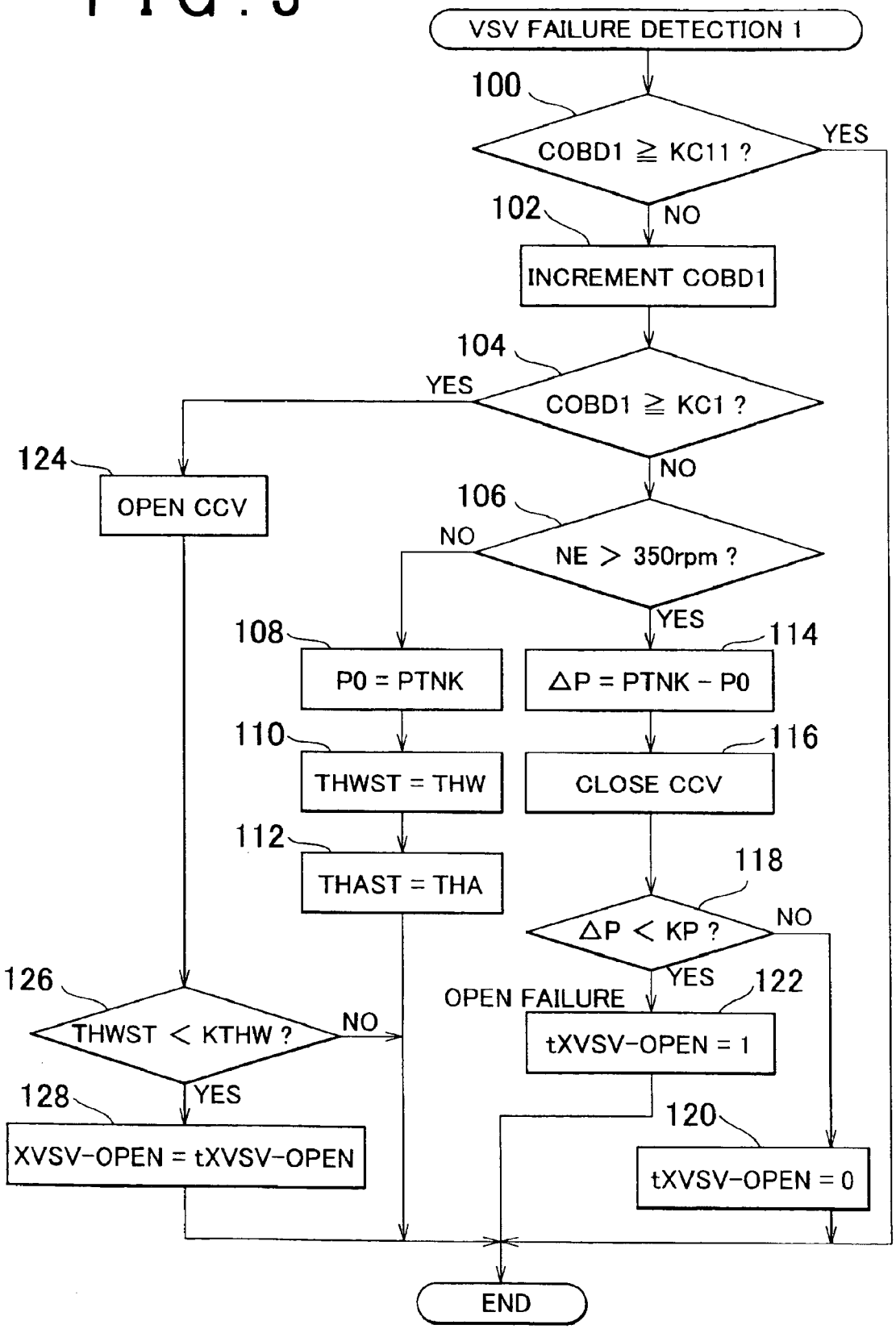
FIG. 3 is a flowchart showing a control routine executed to determine whether an open failure occurs in the purge VSV in the first embodiment of the invention.
Figure 4:
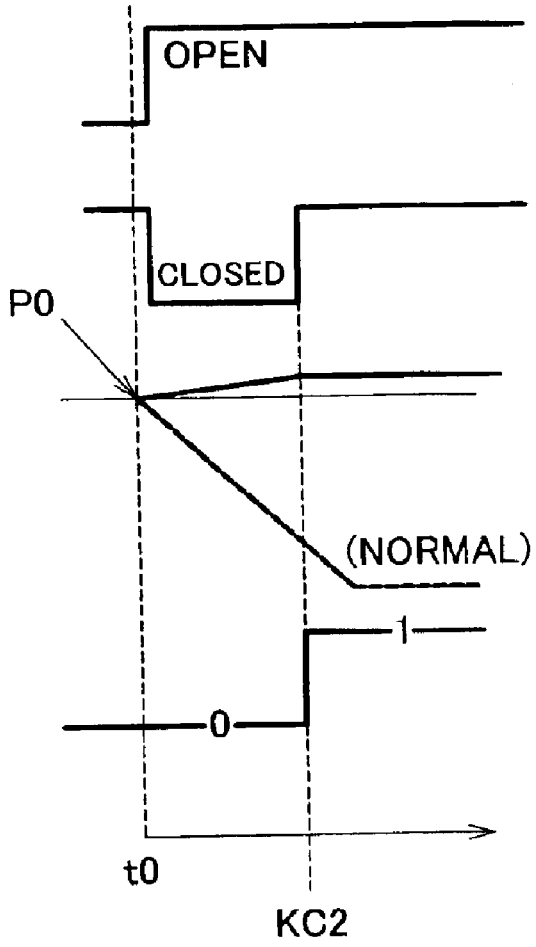
FIGS. 4A–4D is a timing chart explaining the content of a process performed by the system of the first embodiment of the invention for detecting a close failure of the purge VSV.

FIG. 3 is a flowchart showing a control routine executed by the ECU 60 for determining whether an open failure occurs in the purge VSV 28. The routine shown in FIG. 3 is started at the same time that the ignition switch of the vehicle is turned ON, and is repeatedly executed at certain time intervals.

In the routine shown in FIG. 3, it is determined in step S100 whether a counter value COBD1 of a first OBD counter has reached a jump determination value KC11. The first OBD counter is cleared through an initialization process when the ignition switch of the vehicle is turned ON. Immediately after the vehicle is started, it is determined in step S100 that COBD1≧KC11 is not satisfied, namely, the counter value COBD1 has not reached the jump determination value KC11.

If step S100 determines that COBD1≧KC11 is not satisfied, the counter value COBD1 of the first OBD counter is incremented in step S102. Subsequently, it is determined in step S104 whether the counter value COBD1 has reached a diagnosis determination value KC1. The diagnosis determination value KC1,which corresponds to the timing of determination as to whether an open failure occurs in the purge VSV 28, is smaller by 1 than the above-indicated jump determination value KC1. Immediately after the vehicle is started, step S104 determines that COBD1≧KC1 is not satisfied, namely, the counter value COBD1 has not reached the diagnosis determination value KC1.

If step S104 determines that COBD1≧KC1 is not satisfied, it is then determined in step S106 whether the engine speed NE has exceeded 350 rpm. Here, 350 rpm is a criteria value used for determining whether the engine has entered the stage of complete combustion. Immediately after the engine is started, for example, during a cranking period of the engine, the condition that NE>350 rpm is not satisfied. In this case, the tank pressure PTNK measured at this point in time is stored as a reference pressure P1 in step S108. Then, the coolant temperature THW and the intake air temperature THA measured at this point in time are stored as an initial coolant temperature THWST and an initial intake air temperature THAST in step S110 and step S112, respectively. After execution of step S112, the current cycle of the control routine is finished.

After the start of the engine, the process of steps S100–S112 as described above is repeatedly carried out each time the routine shown in FIG. 3 is executed until the engine speed NE reaches 350 rpm. Consequently, the ECU 60 stores the tank pressure PTNK measured at a point in time when the engine speed NE reaches 350 rpm as the reference pressure P1, and stores the coolant temperature THW and intake air temperature THA measured at this time point as the initial coolant temperature THWST and initial intake air temperature THAST.

If the routine shown in FIG. 3 is executed after the engine speed NE reaches 350 rpm, namely, after the engine enters the stage of complete combustion, it is determined in step S106 that NE>350 rpm is satisfied. In this case, a pressure difference ΔP (=PTNK−P0) between the tank pressure PTNK at this point in time and the reference pressure P1 is then calculated in step S114. The pressure difference ΔP is calculated as a value in the vicinity of zero when the tank pressure PTNK is not significantly reduced after complete combustion of the engine, and is calculated as a negative value when the tank pressure PTNK is significantly reduced.

In the routine shown in FIG. 3, step S114 is followed by step S116 in which the CCV 22 is closed. It is then determined in step S118 whether the pressure difference ΔP is smaller than the open failure determination value KP. Namely, it is determined whether a significant reduction in the tank pressure PTNK takes place after the engine enters the stage of complete combustion. If step S118 determines that ΔP<KP is not satisfied, the ECU 60 can judge that the intake manifold vacuum has no influence on the tank pressure PTNK. In this case, 0 is set to an open failure provisional determination flag tXVSV-OPEN in step S120 so as to indicate that an open failure of the purge VSV 28 is not recognized at this point in time. If step S118 determines that ΔP<KP is satisfied, on the other hand, the intake manifold vacuum has an influence on the tank pressure PTNK. Namely, the ECU 60 can judge that the purge VSV 28 is open. In this case, 1 is set to the open failure provisional determination flag tXVSV-OPEN in step S122 so as to indicate that an open failure of the purge VSV 28 is recognized.

During a period from the time when the engine enters the complete combustion stage to the timing of determination as to whether an open failure occurs in the purge VSV 28, namely, until the counter value COBD1 of the first OBD counter reaches the diagnosis determination value KC1,the process of steps S100–S106 and steps S114–S122 as described above is repeated each time the routine shown in FIG. 3 is executed. As a result, the final value of the open failure provisional determination flag tXVSV-OPEN is set in the control cycle immediately before COBD1 reaches KC1.

If step S104 determines that COBD1≧KC1 is satisfied after the start of the routine shown in FIG. 3, the ECU 60 can judge that the time has come when the presence or the absence of an open failure should be determined. In this case, the CCV 22 is opened in step S124, and it is determined in step S126 whether the initial coolant temperature THWST is lower than a cold-start criteria value KTHW.

The cold-start criteria value KTHW is a criteria value used for determining whether there is a possibility of generation of a large amount of fuel vapor in the fuel tank 10. If it is determined that the initial coolant temperature THWST is not lower than KTHW (i.e., if a negative determination is made in step S126), the ECU 60 can judge that there is a possibility of generation of a large amount of fuel vapor in the fuel tank 10 when the engine is started. In this situation, the pressure difference ΔP may be influenced by the fuel vapor generated in the fuel tank 10, and an error is likely to occur in the determination based on the pressure difference ΔP. In the routine shown in FIG. 3, therefore, if step S126 determines that THWST<KTHW is not satisfied, namely, THWST is equal to or larger than KTHW, the ECU 60 finishes the current cycle of the control routine without making a final determination concerning an open failure of the purge VSV 28. With this process, an erroneous determination on the presence of an open failure of the purge VSV 28 is prevented from being made, for example, when the engine is re-started in warm conditions.

If step S126 determines that THWST<KTHW is satisfied, namely, the initial coolant temperature THWST is lower than the criteria value KTHW, the ECU 60 can judge that the pressure difference ΔP is not significantly influenced by fuel vapor in the fuel tank 10. In this case, the value of the open failure provisional determination flag tXVSV-OPEN is set as a value of the open failure determination flag XVSV-OPEN in step S128. Thereafter, the ECU 60 determines that an open failure occurs in the purge VSV 28 if the flag XVSV-OPEN is set at 1, and that no open failure occurs in the purge VSV 28 if the flag XVSV-OPEN is set at 0.

When the routine shown in FIG. 3 is executed again after the above-described series of operations are finished, it is determined in step S100 that COBD1≧KC11 (=KC1+1) is satisfied. In this case, the ECU 60 skips step S102 and subsequent steps, and finishes the routine of FIG. 3 without performing any substantial process. In the present embodiment, the ECU 60 can accurately determine whether an open failure occurs in the purge VSV 28 immediately after a start of the engine, by executing the routine of FIG. 3 as explained above.

3. Determination of Close Failure of Purge VSV

FIGS. 4A–4D is a timing chart explaining the content of a process for detecting a close failure of the purge VSV 28. More specifically, FIG. 4A indicates the state of the purge VSV 28 after the process of detecting an open failure as shown in FIG. 3 is finished. Time t0 shown in FIG. 4A–4D represents a point in time when the purge VSV 28 is opened for the first time after the engine is started. The purge VSV 28 is controlled to be held in the closed state after the start of the engine until a predetermined time equivalent to the above-indicated jump determination value KC11 (step S100 in FIG. 3) elapses. Thus, time t0 comes after the counter value COBD1 reaches the jump determination value KC11.

FIG. 4B indicates the state of the CCV 22 during execution of the close failure determination process. KC2 shown in FIG. 4A–4D represents a point in time at which it should be determined whether a close failure occurs in the purge VSV 28, namely, represents the time of finish of the close failure determination process. As shown in FIG. 4B, the CCV 22 is controlled to be held in the closed state after the purge VSV 28 is opened at time t0, until the close failure determination process is finished at time KC2.

FIG. 4C indicates changes in the tank pressure PTNK during execution of the close failure detection process. More specifically, the pattern indicated by the broken line in FIG. 4C represents the tank pressure PTNK measured when the purge VSV 28 is normal, and the pattern indicated by the solid line in FIG. 4C represents the tank pressure PTNK measured when the purge VSV 28 suffers a close failure. When the purge VSV 28 is properly opened during execution of the close failure detection process, the intake manifold vacuum is drawn to the canister 20. Since the CCV 22 is held in the closed state during execution of the close failure detection process as described above, the manifold vacuum drawn to the canister 20 reaches the fuel tank 10. As a result, the tank pressure PTNK should change by a large degree to the negative pressure side after time t0, as indicated by the broken line in FIG. 4C, if no close failure occurs in the purge VSV 28. If a close failure occurs in the purge VSV 28, on the other hand, introduction of the intake manifold vacuum is prevented by the closed purge VSV 28, and therefore the tank pressure PTNK is not significantly reduced as indicated by the solid line in FIG. 4C. Thus, the system of the present embodiment is able to determine the presence or the absence of a close failure of the purge VSV 28 by, in principle, determining whether the tank pressure PTNK is significantly reduced after the start of the close failure detection process.

FIG. 4D indicates the state of a close failure determination flag XVSV-CLOSE, which indicates whether a close failure occurs in the purge VSV 28. When the tank pressure PTNK changes as indicated by the solid line in FIG. 4C, the ECU 60 judges that no significant reduction in the tank pressure PTNK appears at the time of finish of the close failure detection process (i.e., at time KC2). In this case, 1 is set to the close failure determination flag XVSV-CLOSE, as shown in FIG. 4D.

Figure 5:
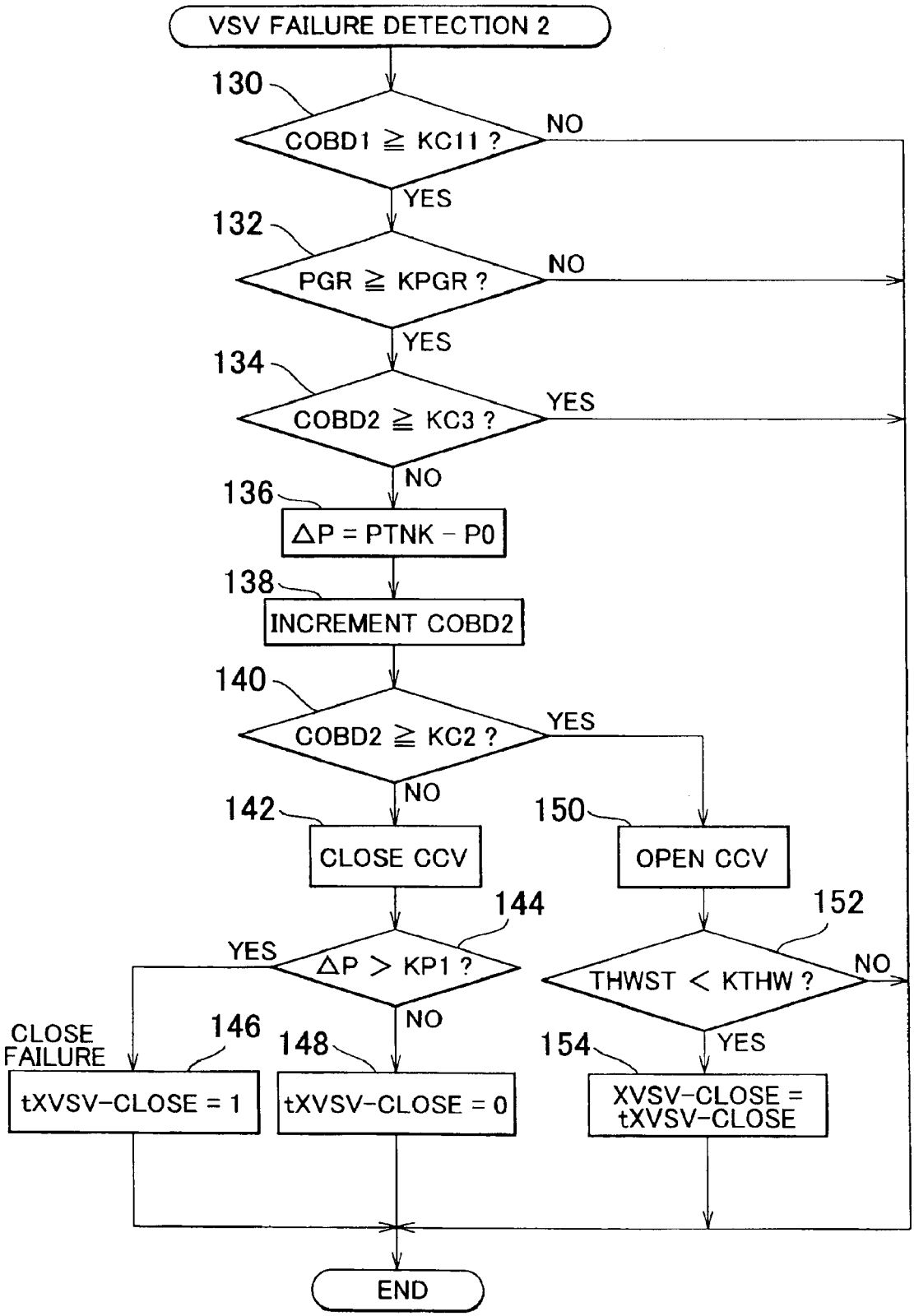
FIG. 5 is a flowchart showing a control routine executed to determine whether a close failure occurs in the purge VSV in the first embodiment of the invention.

FIG. 5 is a flowchart showing a control routine executed by the ECU 60 for determining whether a close failure occurs in the purge VSV 28. The routine shown in FIG. 5 is repeatedly executed at certain time intervals after the ignition switch of the vehicle is turned ON.

In the routine shown in FIG. 5, it is determined in step S130 whether the counter value COBD1 of the first OBD counter has reached the jump determination value KC11 as described above. If step S130 determines that COBD1≧KC11 is not satisfied, namely, COBD1 is smaller than KC11, the current cycle of the control routine is immediately finished. Thus, the process of step S132 and subsequent steps is executed only after COBD1≧KC11 is satisfied, namely, only after the open failure detection process of FIG. 3 as described above is finished.

If step S130 determines that COBD1≧KC11 is satisfied, it is then determined in step S132 whether the purge ratio PGR is equal to or larger than a criteria value KPGR. The purge ratio PGR is the ratio of the purge flow rate QPG to the flow rate of intake air GA, i.e., "(QPG/GA)×100". The purge flow rate QPG is the flow rate of purge gas flowing from the canister 20 to the intake passage 30 through the purge VSV 28, and can be calculated by a known method based on the opening angle (or drive duty) of the purge VSV 28 and the intake manifold vacuum PM. In the present embodiment, the drive duty of the purge control valve 28 is calculated in a routine different from the routine shown in FIG. 5, and the purge ratio PGR resulting from the drive duty is also calculated in another routine. In step S132, the purge ratio PGR calculated in another routine is read, and it is determined whether PGR≧KPGR is satisfied.

If it is determined in step S132 that PGR≧KPGR is not satisfied, namely, PGR is smaller than KPGR, the ECU 60 can judge that a vacuum large enough to determine the presence of a close failure of the purge VSV 28 is not drawn to the purge conduit 26. In this case, the subsequent process needed for determination of a close failure is not conducted, and the current cycle of the control routine is immediately finished. If step S132 determines that PGR≧KPGR is satisfied, the ECU 60 can judge that a sufficiently large vacuum for determining the presence of a close failure of the purge VSV 28 is drawn to the purge conduit 26. In this case, it is determined in step S134 whether a counter value COBD2 of a second OBD counter has reached a finish determination value KC3.

Like the first OBD counter, the second OBD counter is cleared through an initialization process when the ignition switch is turned ON. Immediately after the start of the close failure determination process, step S134 determines that COBD2≧KC3 is not satisfied, namely, COBD2 is smaller than KC3. In this case, a pressure difference ΔP (=PTNK−P0) between the tank pressure PTNK at this point in time and the reference pressure P1 as described above is calculated in step S136. In the next step S138, the counter value COBD2 of the second OBD counter is incremented.

In the routine shown in FIG. 5, it is then determined in step S140 whether the counter value COBD2 of the second OBD counter has reached a diagnosis determination value KC2. The diagnosis determination value KC2, which corresponds to the timing of determination as to whether a close failure occurs in the purge VSV 28, is smaller by 1 than the above-indicated finish determination value KC3. Immediately after the start of the close failure determination process, step S140 determines that COBD2≧KC2 is not satisfied, namely, COBD2 is smaller than KC2.

If step S140 determines that COBD2≧KC2 is not satisfied, the CCV 22 is closed in step S142. It is then determined in step S144 whether the above-indicated pressure difference ΔP is larger than a close failure determination value KP1. The close failure determination value KP1 is larger than the pressure difference ΔP (a negative value) obtained when the purge VSV 28 is properly opened. Thus, when step S144 determines that ΔP>KP1 is satisfied, the ECU 60 can judge that a close failure occurs in the purge VSV 28. In this case, the ECU 60 sets 1 to a close failure provisional determination flag tXVSV-CLOSE in step S146 so as to indicate that a close failure occurs in the purge VSV 28. If step S144 determines that ΔP>KP1 is not satisfied, on the other hand, the ECU 60 can judge that no close failure of the purge VSV 28 is recognized. In this case, the ECU 60 sets 0 to the close failure provisional determination flag tXVSV-CLOSE in step S148 so as to indicate that no close failure of the purge VSV 28 is recognized.

After the close failure determination process is started, the process of steps S130–S148 as described above is repeated each time the routine shown in FIG. 5 is executed under circumstances where the purge ratio PGR is sufficiently large, until the counter value COBD2 of the second OBD counter reaches the diagnosis determination value KC2. Consequently, the final value of the close failure provisional determination flag tXVSV-CLOSE is set in the control cycle immediately before COBD2 reaches KC2.

If it is determined in step S140 that COBD2≧KC2 is satisfied after the routine shown in FIG. 5 is started, the ECU 60 can judge that the time has come when the presence or the absence of a close failure should be determined. In this case, the CCV 22 is opened in step S150, and it is determined in step S152 whether the initial coolant temperature THWST is lower than a cold-start criteria value KTHW. If it is determined that THWST<KTHW is not satisfied, namely, THWST is equal to or higher than KTHW, the ECU 60 finishes the current cycle of the routine without making a final determination regarding a close failure of the purge VSV 28, for the same reason (step S126 in FIG. 3) as in the case of the open failure determination process. Thus, the system of the present embodiment is able to prevent an erroneous determination on the presence of a close failure of the purge VSV 28 from being made, for example, when the engine is re-started in warm conditions.

If step S152 determines that THWST<KTHW is satisfied, the value of the close failure provisional determination flag tXVSV-CLOSE is set as a value of the close failure determination flag XVSV in step S154. Thereafter, the ECU 60 judges that a close failure occurs in the purge VSV 28 when XVSV-CLOSE is set at 1, and judges that no close failure occurs in the purge VSV 28 when XVSV-CLOSE is set at 0.

When the routine shown in FIG. 5 is executed again after the above-described series of operations are finished, it is determined in step S134 that the counter value COBD2 of the second OBD counter has reached the finish determination value KC3 (=KC2+1). In this case, the ECU 60 skips step S136 and subsequent steps, and finishes the routine of FIG. 5 without performing any substantial process. In the present embodiment, the ECU 60 can accurately determine whether a close failure occurs in the purge VSV 28 immediately after the start of the engine, by executing the routine of FIG. 5 as explained above.

4. Purge Control

If the purge VSV 28 fails, the system of the present embodiment cannot perform normal purge control, namely, the system cannot appropriately control the purge flow rate QPG. More specifically, if an open failure occurs in the purge VSV 28, purge gas constantly flows through the system during operations of the engine, and the flow of the purge gas cannot be stopped. If a close failure occurs in the purge VSV 28, purge gas cannot flow in the system.

In a normal control method, the ECU 60 determines whether certain execution conditions as preconditions for execution of purge control are satisfied. The execution conditions are determined to be satisfied under circumstances where the operating conditions of the engine do not deteriorate and no significant fluctuations appear in the air/fuel ratio even if purge gas flows into the intake passage 30. In normal control, purging of fuel vapor is conducted only under a situation where the execution conditions are satisfied, and, during execution of purge control, the fuel injection time TAU is corrected so as to cancel or eliminate an influence of the purge gas.

When an open failure occurs in the purge VSV 28, however, the purge gas continuously flows into the intake passage 30 during operation of the engine irrespective of a command of the ECU 60. Namely, the purge gas flows into the intake passage 30 even under a situation where the purge control execution conditions are not satisfied and the ECU 60 does not generate a command for execution of purge control. In this case, if the fuel injection time TAU is calculated according to the normal control method assuming that no purge gas flows into the intake passage 30, the air/fuel ratio may fluctuate due to an influence of the purge gas. Accordingly, when the purge VSV 28 suffers an open failure, it is desirable to appropriately switch or change the control method so as to avoid the problem as described above.

When a close failure occurs in the purge VSV 28, no purge gas flows into the intake passage 30 irrespective of a command of the ECU 60. In this case, if the fuel injection time TAU is calculated according to the normal control method on the assumption that purge gas flows into the intake passage 30, an appropriate air/fuel ratio cannot be established. Accordingly, when the purge VSV 28 suffers a close failure, it is desirable to switch or change the control method so as to avoid the situation as described above.

As explained above, when the purge VSV 28 suffers an open failure or a close failure, it is desirable for the system of the present embodiment to perform control of the engine by a method different from that employed in the case where the purge VSV 28 is normal. To this end, the ECU 60 recognizes a failure of the purge VSV 28 while distinguishing an open failure from a close failure by the above-described methods (as shown in FIG. 2 through FIG. 5), and switches the control method so as to achieve the optimum result as needed, depending upon the mode or type of the failure.

Figure 6:
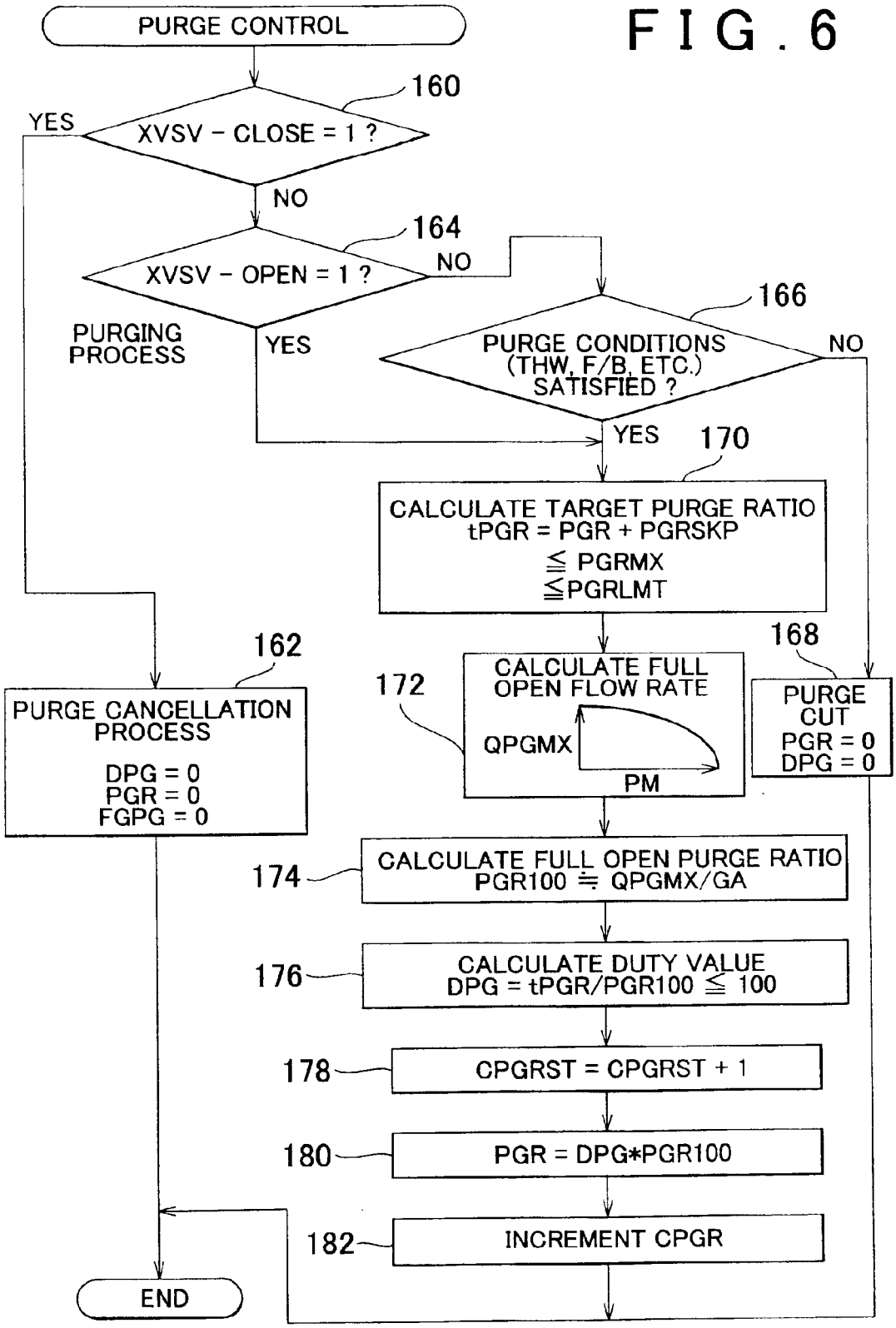
FIG. 6 is a flowchart showing a control routine executed for purge control in the first embodiment of the invention.

FIG. 6 is a flowchart showing a purge control routine executed by the ECU 60 for accomplishing the above-described functions. In the routine shown in FIG. 6, it is determined in step S160 whether the close failure determination flag XVSV-CLOSE is set at 1. If it is determined that XVSV-CLOSE is equal to 1, the ECU 60 can judge that a close failure occurs in the purge VSV 28. In this case, a purge cancellation process is performed in step S162 in which the drive duty DPG of the purge VSV 28 is made equal to 0, the purge ratio PGR is made equal to 0, and the vapor concentration learned value FGPG is made equal to 0. Subsequently, the current cycle of the control routine is finished.

Since no purge gas flows in the system in the event of a close failure of the purge VSV 28, the fuel injection time TAU is calculated on the assumption that no purge gas is present, so that highly accurate air/fuel ratio control can be expected to be realized. If the drive duty DPG is set at 0, the purge VSV 28 can be kept in the closed state. The purge ratio PGR is the ratio of the purge flow rate QPG to the intake air flow rate (or air mass flow) GA, as described above. The vapor concentration learned value FGPG is a proportion of correction of TAU per 1% of the purge ratio, or a factor that physically means the fuel concentration of the purge gas. The purge ratio PGR and the vapor concentration learned value FGPG provide the basis of calculation of the fuel injection time TAU so as to eliminate an influence of the purge gas, as described later. If these factors PGR, FGPG are set at 0, the fuel injection time TAU is calculated on the assumption that no purge gas is present. With the purge cancellation process of the above step S162, even in the situation where a close failure occurs in the purge VSV 28, the system of the present embodiment is able to achieve highly accurate air/fuel ratio control without being influenced by the close failure of the purge VSV 28.

In the routine shown in FIG. 6, if it is determined in step S160 that XVSV-CLOSE=1 is not satisfied, it is then determined in step S164 whether the open closure determination flag XVSV-OPEN is set at 1. If it is determined that XVSV-OPEN=1 is not satisfied, namely, XVSV-OPEN is not equal to 1, no open failure occurs in the purge VSV 28, in other words, the purge VSV 28 can be judged as being normal. In this case, it is determined in step S166 whether purge conditions are satisfied. As the purge conditions, it may be determined, for example, whether the coolant temperature THW is equal to or higher than a purge permissible temperature KTHWPG, or whether air/fuel ratio feedback control based on the output of the oxygen sensor 52 is being carried out.

If it is determined in step S166 that the purge conditions are not satisfied, the ECU 60 judges that execution of a purging process is not necessarily appropriate, and the purge ratio PGR and the drive duty DPG are both made equal to 0 in step S168. Thereafter, the current cycle of the control routine is finished. It is to be noted that the vapor concentration learned value FGPG is not reset in step S168. If learning of FGPG is in progress at this time, therefore, a process using the learned FGPG will be started after the purge conditions are satisfied.

If step S166 determines that the purge conditions are satisfied, a process of purging the canister 20 of fuel vapor is carried out. More specifically, a target purge ratio tPGR is calculated in step S170. The target purge ratio tPGR is basically calculated by adding a skip value PGRSKP to the current purge ratio PGR. In step S170, the upper limit of the target purge ratio tPGR is defined by the maximum purge ratio PGRMX or the limit purge ratio PGRLMT. In this specification, detailed explanation of PGRMX and PGRLMT is not provided.

Subsequently, a full open flow rate QPGMX is calculated in step S172. The full open flow rate QPGMX is the flow rate QPG of purge gas that is expected to flow from the canister 20 into the intake passage 30 when the purge control valve 28 is fully opened. The ECU 60 stores a map of the full open flow rate QPGMX defined in relation to the intake manifold vacuum PM as shown in the block of step S172 in FIG. 6. In step S172, the full open flow rate QPGMX is calculated with reference to this map. The intake manifold vacuum PM may be estimated by a known method, for example, based on the intake air flow rate GA and the throttle opening TA.

Subsequently, a full open purge ratio PGR100 (=QPGMX/GA) is calculated in step S174. The PGR100 is the ratio of the full open flow rate QPGMX to the intake air flow rate GA. In the next step S176, the drive duty DPG for achieving the target purge ratio tPGR is calculated. The drive duty DPG is basically calculated by dividing the target purge ratio tPGR by the full open purge ratio PGR100, namely, according to DPG=tPGR/PGR100, though the upper limit of the drive duty DPG is defined as 100. Thereafter, the purge VSV 28 is duty-driven at the drive duty ratio DPG calculated in step S176.

After incrementing a purge start counter CPGRST (which will not be explained) in step S178, the ECU 60 calculates a final purge ratio PGR (=DPG×PGR100) in step S180. After a purge counter (which will not be explained) is incremented in step S182, the current cycle of the control routine is finished. The final purge ratio PGR calculated in step S180 provides a basis for calculation of the target purge ratio tPGR in the next control cycle, and provides a basis for calculation of the fuel injection time TAU in another routine executed by the ECU 60.

As explained above, according to the routine shown in FIG. 6, it is determined whether the purge conditions are satisfied when it is recognized that the purge VSV 28 is normal, and the processes of driving the purge VSV 28 at a suitable duty ratio and calculating the final purge ratio PGR are performed only when the purge conditions are determined to be satisfied. Only under a situation where it is confirmed that the purge VSV 28 can be normally closed, the purging process is inhibited from being executed when the purge conditions are not satisfied, and the fuel injection time TAU is calculated on the assumption that no purge gas is present (i.e., PGR=0). With this arrangement, the engine can be controlled to an optimum operating state when the purge VSV 28 is normal, and the fuel injection time TAU is surely prevented from being calculated on the assumption that no purge gas is present when the purge VSV 28 suffers an open failure.

In the routine shown in FIG. 6, when it is determined in step S164 that the open failure determination flag XVSVOPEN is set at 1, the ECU 60 can judge that an open failure occurs in the purge VSV 28. In this case, the ECU 60 unconditionally executes the process of step S170 and subsequent steps, i.e., the process of calculating the drive duty DPG and the final purge ratio PGR, without determining whether or not the purge conditions are satisfied. In this case, a drive signal corresponding to the drive duty DPG is supplied to the purge VSV 28, and the ECU 60 calculates the fuel injection time TAU that reflects the purge ratio PGR.

The purge VSV 28, when suffering an open failure, is not able to operate in accordance with the drive signal supplied thereto. Accordingly, the purge ratio PGR calculated in this case is different from the actual value. According to the process as described above, however, the fuel injection time TAU can be calculated in the event of an open failure of the purge VSV 28 at least on the assumption that purge gas flows in the system. According to the routine shown in FIG. 6, the fuel injection time TAU can be always calculated in this manner, irrespective of whether the purge conditions are satisfied.

Even if the calculated value of the purge ratio PGR is different from the actual value, the air/fuel ratio is controlled with improved accuracy in the case where the fuel injection time TAU is calculated to reflect the calculated value (PGR), as compared with the case where the fuel injection time TAU is calculated without regard to an influence of purge gas. Also, since flow of purge gas cannot be stopped even in a situation where the purge execution conditions are not satisfied, more excellent air/fuel ratio control can be realized by using the fuel injection time TAU that reflects an influence of purge gas (PGR), rather than using the fuel injection time TAU that does not involve the purge influence at all. Thus, the routine shown in FIG. 6 makes it possible to maintain the accuracy of control of the air/fuel ratio at a sufficiently high level even when the purge VSV 28 suffers an open failure.

Figure 7:
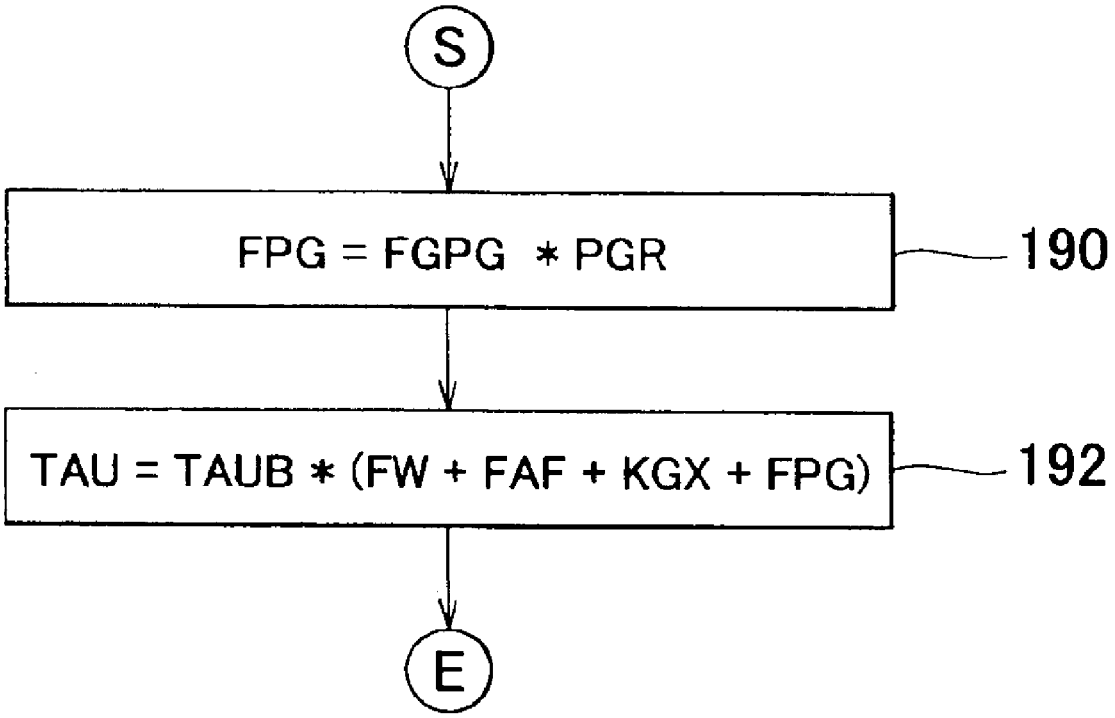
FIG. 7 is a flowchart showing a control routine executed to calculate a fuel injection time in the first embodiment of the invention.
Figure 8:
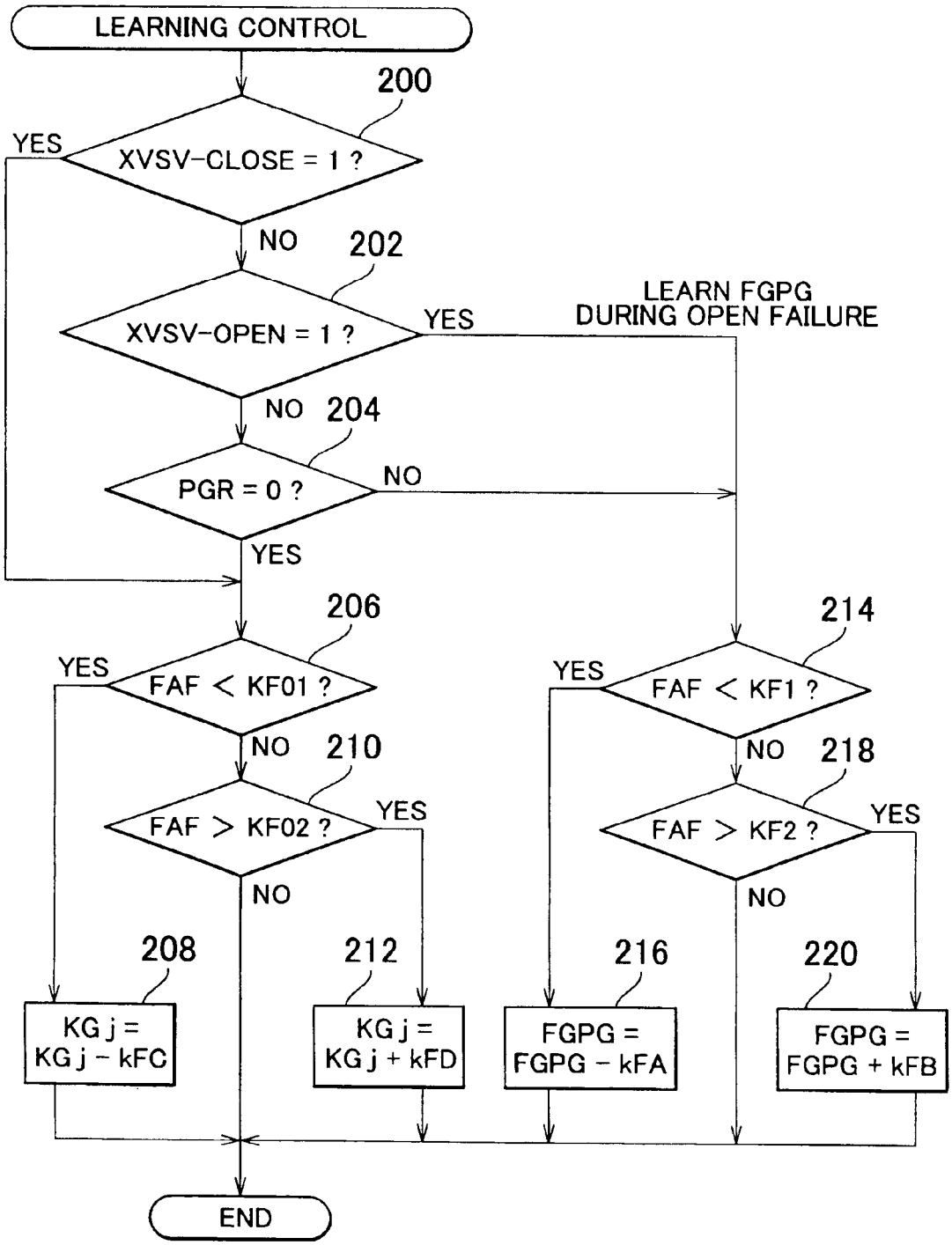
FIG. 8 is a flowchart showing a control routine executed for learning control in the first embodiment of the invention.

Referring next to FIG. 7 and FIG. 8, the reason why the system of the present embodiment provides improved accuracy of air/fuel ratio control in the event of an open failure or a close failure of the purge VSV 28 will be further explained.

FIG. 7 is a flowchart showing a routine executed by the ECU 60 for calculating the fuel injection time TAU. As shown in FIG. 7, the ECU 60 initially calculates a purge correction factor FPG in step S190 according to the following expression (1) in the process of calculating the fuel injection time TAU.

$$FPG=FGPG\times PGR \tag{1}$$

In the above expression (1), FGPG is vapor concentration learned value that means the proportion of correction of TAU per 1% of the purge ratio, as described above, and PGR is purge ratio that means the ratio of the purge flow rate QPG to the intake air flow rate GA.

Next, the ECU 60 calculates the fuel injection time TAU in step S192 according to the following expression (2).

$$TAU=TAUB\times(FW+FAF+KGX+FPG) \tag{2}$$

In the above expression (2), TAUB is the basic fuel injection time for achieving the target air/fuel ratio, which time is calculated in relation to the intake air flow rate GA, and FW is a water temperature factor that realizes correction for increasing the fuel injection amount during a cold start of the engine. FAF is an air/fuel ratio feedback factor that is increased or reduced based on the output of the oxygen sensor 52 so that the exhaust air/fuel ratio approaches the target air/fuel ratio. KGX is a learned value that absorbs influences of chronological changes of the engine, and the like. The learned value KGX is a factor that is learned in association with each of a plurality of engine operating regions established on the basis of the intake air flow rate GA, and "X" affixed to "KG" represents the operating region. FPG included in the above expression (1) is the purge correction factor calculated in the above step S190.

FIG. 8 is a flowchart of a learning control routine executed by the ECU 60 during an operation of the engine for learning the above-described learned value KGX and vapor concentration learned value FGPG. In the routine shown in FIG. 8, it is determined in step S200 whether the close failure determination flag XVSV-CLOSE is set at 1. If it is determined that XVSV-CLOSE is not equal to 1, it is then determined in step S202 whether the open failure determination flag XVSV-OPEN is set at 1. If it is determined that XVSV-OPEN is not equal to 1, the ECU 60 can judge that the purge VSV 28 is normal.

If the ECU 60 can judge that the purge VSV 28 is normal, it is then determined in step S204 whether the current purge ratio PGR is equal to 0. If it is determined that the purge ratio PGR is equal to 0, the ECU 60 can judge that the purge VSV 28 is surely closed and no purge gas is present in the system. Namely, the ECU 60 can judge that purge gas has no influence on the relationship between the fuel injection time TAU and the exhaust air/fuel ratio. In this case, the ECU 60 executes a process of learning the learned value KGX in the following steps.

In the learning process of the learned value KGX, it is determined in step S206 whether the air/fuel ratio feedback factor FAF is smaller than a rich-side criteria value KF01. The air/fuel ratio feedback factor FAF is updated to be reduced so as to shift the exhaust air/fuel ratio to the leaner side while the oxygen sensor 52 is generating a rich output signal, and is updated to be increased so as to shift the exhaust air/fuel ratio to the richer side while the oxygen sensor 52 is generating a lean output signal. Accordingly, when FAF is smaller than KF01, the ECU 60 can judge that the exhaust air/fuel ratio is likely to be on the rich side according to the current TAU calculation logic.

In the routine shown in FIG. 8, when it is determined in step S206 that FAF<KF01 is satisfied, the learned value KGj is updated to a value that is smaller by a predetermined value kFC than the current learned value KGj in step S208 so as to correct the TAU calculation logic. The learned value KGj is a learned value KGX corresponding to the current operating region j. According to the above-indicated expression (2), the fuel injection time TAU is reduced as the learned value KGj is updated to a smaller value. With step S208 thus executed, therefore, the learned value KGj can be appropriately updated so that the exhaust air/fuel ratio has a reduced tendency to be rich.

In the routine shown in FIG. 8, if it is determined in step S206 that FAF<KF01 is not satisfied, i.e., FAF is equal to or larger than KF01, it is then determined in step S210 whether the air/fuel ratio feedback factor FAF is larger than a lean-side criteria value KF02. If step S210 determines that FAF>KF02 is not satisfied, the current learned value KGj can be judged as an appropriate value. In this case, the ECU 60 finishes the current cycle of the control routine without changing the learned value KGj.

If it is determined in step S210 that FAF>KF02 is satisfied, the ECU 60 can judge that the current learned value KGj causes the exhaust air/fuel ratio to be likely to be on the lean side, namely, that the current learned value KGj is an excessively small value. In this case, the ECU 60 updates the learned value KGj to a value that is larger by a predetermined value kFD than the current learned value KGj in step S212. With step S212 thus executed, the learned value KGj can be corrected to an appropriate value, and the exhaust air/fuel ratio has a reduced tendency to shift to the lean side. Thus, according to the routine shown in FIG. 8, when the purge VSV 28 is normal, the learned value KGj can be appropriately updated based on the tendency of the exhaust air/fuel ratio, under a situation where the purge ratio PGR is equal to 0 and purge gas has no influence on the tendency of the exhaust air/fuel ratio.

In the routine shown in FIG. 8, if step S204 determines that the purge ratio PGR is not equal to 0, the ECU 60 can judge that a command to open the purge VSV 28 is generated to the normally operating purge VSV 28 so as to cause purge gas to flow in the system. Namely, the ECU 60 can judge that a certain amount of purge gas is sure to flow in the system. Assuming that the learned value KGX is updated to an appropriate value, the shifting tendency of the exhaust air/fuel ratio under this situation can be regarded as an influence of the purge gas. In this case, the ECU 60 executes a process of learning the vapor concentration learned value FGPG so as to correct the logic for evaluating the influence of the purge gas.

In the learning process of the vapor concentration learned value FGPG, it is determined in step S214 whether the air/fuel ratio feedback factor FAF is smaller than a rich-side criteria value KF1. If it is determined that FAF<KF1 is satisfied, the ECU 60 can judge that the current purge correction factor FPG causes the exhaust air/fuel ratio to be likely to be on the rich side. Namely, the ECU 60 can judge that the vapor concentration learned value FGPG needs to be corrected so that the purge correction factor FPG becomes a smaller value. In this case, the ECU 60 updates the vapor concentration learned value FGPG to a value that is smaller than the current value FGPG by a predetermined value kFA in step S216. With the vapor concentration learned value FGPG thus reduced, the purge correction factor FPG relative to the same purge ratio PGR is reduced, resulting in a reduced tendency of the exhaust air/fuel ratio to shift to the rich side. With step S216 thus executed, the vapor concentration value FGPG can be appropriately updated in a direction to reduce the shift amount of the exhaust air/fuel ratio.

In the routine shown in FIG. 8, if step S214 determines that FAF<KF1 is not satisfied, i.e., FAF is equal to or larger than KF1, it is then determined in step S218 whether the air/fuel ratio feedback factor FAF is larger than a lean-side criteria value KF2. If it is determined that FAF>KF2 is not satisfied, the current purge correction factor FPG is an appropriate value. Namely, the current vapor concentration learned value FGPG can be judged as an appropriate value. In this case, the ECU 60 finishes the current cycle of the control routine without changing the vapor concentration learned value FGPG.

If step S218 determines that FAF>KF2 is satisfied, on the other hand, the ECU 60 can judge that the current vapor concentration learned value FGPG causes the exhaust air/fuel ratio to be likely to be on the lean side. In this case, the ECU 60 updates the vapor concentration learned value FGPG to a value that is larger than the current value FGPG by a predetermined value kFB in step S220. With this process, the vapor concentration learned value FGPG can be corrected to an appropriate value, and the exhaust air/fuel ratio has a reduced tendency to shift to the rich side. Thus, according to the routine shown in FIG. 8, when the purge VSV 28 is normal, the vapor concentration learned value FGPG can be appropriately updated based on the tendency of the exhaust air/fuel ratio under a situation where the purge ratio PGR is not equal to 0.

In the routine shown in FIG. 8, if it is determined in step S200 that the close failure determination flag XVSV-CLOSE is set at 1, the process of step S206 and subsequent steps, i.e., the process of updating the learned value KGX, is unconditionally started. When XVSV-CLOSE=1 is satisfied, the ECU 60 can judge that a close failure occurs in the purge VSV 28, and no purge gas flows into the intake passage 30. Namely, the ECU 60 can judge that purge gas has no influence on the tendency of the exhaust air/fuel ratio as in the case where a command of PGR=0 is generated to the normally operating purge VSV 28.

As explained above with reference to FIG. 6, the ECU 60 cancels or stops purge control (in step S162) in the event of a close failure of the purge VSV 28. In this case, the ECU 60 controls the fuel injection time TAU while executing the process of updating the learned value KGX as described above. With this process, it is possible to control the air/fuel ratio in a situation where a close failure occurs in the purge VSV 28, with the same level of accuracy as in the case where purging is stopped with the purge VSV 28 being normal. Thus, the system of the present embodiment is able to achieve excellent air/fuel ratio control irrespective of occurrence of a close failure of the purge VSV 28.

In the routine shown in FIG. 8, if it is determined in step S202 that the open failure determination flag XVSV-OPEN is set at 1, the process of step S214 and subsequent steps, namely, the process of updating the vapor concentration learned value FGPG, is unconditionally started. When XVSV-OPEN=1 is satisfied, the ECU 60 can judge that an open failure occurs in the purge VSV 28, and purge gas constantly flows into the intake passage 30. In this case, the ECU 60 can judge that the tendency of the exhaust air/fuel ratio is constantly influenced by the purge gas flowing into the intake passage 30.

As explained above with reference to FIG. 6, when the purge VSV 28 suffers an open failure, the ECU 60 calculates the purge ratio PGR without exception, i.e., without determining whether the purge conditions are satisfied or not. In this case, the ECU 60 calculates the fuel injection time TAU while executing the process of updating the vapor concentration learned value FGPG as described above, so that the updated learned value FGPG is reflected by the fuel injection time TAU. With this process, when an open failure occurs in the purge VSV 28, the fuel injection time TAU can be always calculated on the assumption that purge gas is present in the system, such that the concentration of the purge gas is reflected by the fuel injection time TAU. Thus, the system of the present embodiment is able to achieve excellent air/fuel ratio control irrespective of occurrence of an open failure of the purge VSV 28.

In the first embodiment as described above, the purge VSV corresponds to "purge control valve" as mentioned above in "SUMMARY OF THE INVENTION", a portion of the ECU 60 that executes the routines of FIG. 3 and FIG. 5 provides the above-mentioned "failure determining unit", a portion of the ECU 60 that executes step S176 of FIG. 6 provides the above-mentioned "purging unit", a portion of the ECU 60 that executes steps S214–S220 of FIG. 8 provides the above-mentioned "fuel concentration learning unit", a portion of the ECU 60 that executes steps S190–S192 of FIG. 7 provides the above-mentioned "fuel injection amount correcting unit", a portion of the ECU 60 that executes step S166 of FIG. 6 provides the above-mentioned "purge condition determining unit", a portion of the ECU 60 that requests the processes of steps S176, S214–S220 and S190–S192 when the purge VSV 28 is normal provides the above-mentioned "normal process requesting unit", and a portion of the ECU 60 that requests the processes of steps S214–S220 and S190–S192 when an open failure occurs in the purge VSV 28 provides the above-mentioned "open-failure-mode process requesting unit".

In the first embodiment as described above, a portion of the ECU 60 that executes steps S206–S212 of FIG. 8 provides the above-mentioned "calculation method learning unit", a portion of the ECU 60 that requests the process of steps S206–S212 when the purge VSV 28 is normal provides the above-mentioned "normal-mode learning requesting unit", and a portion of the ECU 60 that requests the process of steps S206–S212 when a close failure occurs in the purge VSV 28 provides the above-mentioned "close-failure-mode learning requesting unit".

In the first embodiment as described above, the CCV 22 corresponds to the above-mentioned "shut-off mechanism", a portion of the ECU 60 that places the purge VSV 28 in the closed state when the engine is started provides the above-mentioned "purge control valve control unit", a portion of the ECU 60 that executes step S114 of FIG. 3 provides the above-mentioned "pressure change calculating unit", a portion of the ECU 60 that executes steps S118–S122 of FIG. 3 provides the above-mentioned "open failure determining unit", a portion of the ECU 60 that executes step S110 of FIG. 3 provides the above-mentioned "temperature environment sensing unit", and a portion of the ECU 60 that executes step S126 of FIG. 3 provides the above-mentioned "determination permitting unit".

In the first embodiment as described above, a portion of the ECU 60 that places the purge VSV 28 in the open state as shown in FIG. 4A provides the above-mentioned "purge control valve control unit", a portion of the ECU 60 that executes step S136 of FIG. 5 provides "pressure change calculating unit", a portion of the ECU 60 that executes steps S144–S148 of FIG. 5 provides the above-mentioned "close failure determining unit", a portion of the ECU 60 that executes step S110 of FIG. 3 provides the above-mentioned "temperature environment sensing unit", and a portion of the ECU 60 that executes step S152 of FIG. 5 provides the above-mentioned "determination permitting unit".

Second Embodiment

Figure 9:
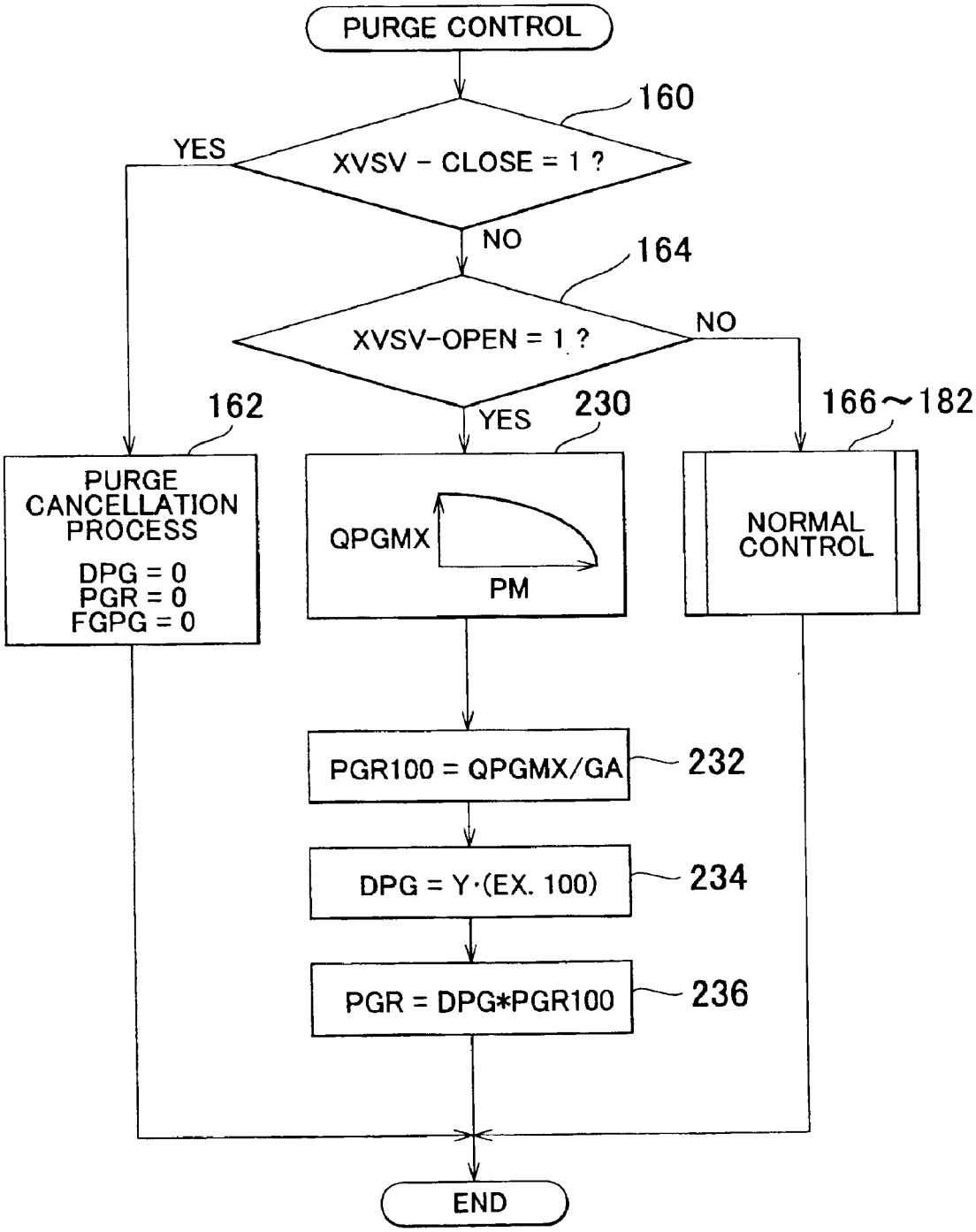
FIG. 9 is a flowchart showing a control routine executed for purge control in a second embodiment of the invention.

Referring next to FIG. 9, the second embodiment of the invention will be described. In the system of the present embodiment having the same construction as that of the first embodiment as shown in FIG. 1, the ECU 60 executes a routine shown in FIG. 9 instead of the routine shown in FIG. 6.

In the first embodiment as described above, when an open failure occurs in the purge VSV 28, the drive duty DPG is calculated in the same manner as in the case where the purge VSV 28 is normal, and the final purge ratio PGR is calculated based on the calculated drive duty DPG, as shown in FIG. 6. In the first embodiment, the fuel injection time TAU is then calculated by using the purge ratio PGR thus calculated, as shown in FIG. 7, when the purge VSV 28 suffers the open failure. Namely, in the first embodiment, the fuel injection time TAU is calculated on the assumption that the opening angle of the purge VSV 28 varies with the drive duty DPG not only when the purge VSV 28 operates normally but also when the purge VSV 28 suffers an open failure.

When an open failure occurs in the purge VSV 28, the opening angle of the purge VSV 28 normally does not change. In the event of an open failure of the purge VSV 28, therefore, the system often operates in the same or similar manner as in the case where the drive duty DPG is kept constant with the purge VSV 28 being normal. Accordingly, it is appropriate to calculate the fuel injection time TAU with the drive duty DPG being fixed so as to achieve control that reflects the actual situation more precisely when the purge VSV 28 suffers an open failure.

FIG. 9 is a flowchart showing a purge control routine executed by the ECU 60 for achieving the appropriate control as described above in the event of an open failure of the purge VSV 28. In FIG. 9, the same reference numerals as used in FIG. 6 are used for identifying steps similar to the steps shown in the routine of FIG. 6, and these steps will not be described or will be only briefly described. In FIG. 9, steps S166–S182 shown in FIG. 6 are denoted by a simple step or process labeled "normal control".

In the routine shown in FIG. 6 as described above, when an open failure occurs in the purge VSV 28, steps S170–S182 are executed as in the case where the purge VSV 28 is normal. The routine shown in FIG. 9 is identical with the routine shown in FIG. 6 except that steps S170–S182 of FIG. 6 executed in the event of an open failure of the purge VSV 28 are replaced by steps S230–S236. Namely, in the routine shown in FIG. 9, if occurrence of an open failure (XVSV-OPEN=1) is recognized in step S164, the full open flow rate QPGMX of purge gas is calculated in step S230. In the next step S232, the full open purge ratio PGR 100 is calculated based on the full open flow rate QPGMX. These steps are substantially similar to steps S172 and S174 executed during normal control, and therefore will not be described in detail.

In the routine shown in FIG. 9, step S232 is followed by step S234 in which a fixed value Y is assigned to the drive duty DPG. Subsequently, the final purge ratio PGR is calculated in step S236 by multiplying the drive duty DPG by the full open purge ratio PGR100 (i.e., PGR=DPG× PGR100). When an open failure occurs in the purge VSV 28, the purge VSV 28 is often stuck in the fully open state. In the present embodiment, therefore, the fixed value Y assigned to the drive duty DPG is set to "100". Accordingly, step S236 always calculates the purge ratio PGR for the case where the purge VSV 28 is fully opened.

When the purge VSV 28 that suffers an open failure is actually stuck in the fully open state, a purge ratio that is equal to the purge ratio PGR calculated in step S236 is always established during operation of the engine. In this case, therefore, an appropriate fuel injection time TAU that accurately cancels an influence of purge gas can be obtained through the process of steps S190 and S192 (FIG. 7) provided that the vapor concentration learned value FGPG correctly represents the concentration of purge gas. In the meantime, if the process of steps S214–S220 as shown in FIG. 8 is repeated under this situation, the vapor concentration learned value FGPG is updated to a value that correctly represents the concentration of the purge gas. Thus, the system of the present embodiment is able to achieve highly accurate air/fuel ratio control by accurately canceling the influence of the purge gas when the purge VSV 29 is stuck in the fully open state.

The system of the present embodiment can also achieve highly accurate air/fuel ratio control in the case where the purge VSV 28 is not stuck in the fully open state. The reason will be explained with reference to an example in which the purge VSV 28 is stuck at an opening angle that is one half (½ ) of the full angle. As explained above, in the present embodiment, the drive duty DPG is fixed to "100" in step S234 when the purge VSV 28 suffers an open failure. Accordingly, when the purge VSV 28 is actually stuck at the opening angle that is one half of the full angle, the final purge ratio PGR calculated in step S236 becomes twice as large as the actual purge ratio. In this respect, the control executed by the ECU 60 does not match the actual situation.

However, if the ratio between the purge ratio PGR recognized by the ECU 60 and the actual purge ratio is constant, the vapor concentration learned value FGPG is updated by learning to a value that cancels this ratio through repeated execution of steps S214–S220 shown in FIG. 8. Namely, in the above example, the vapor concentration learned value FGPG is ultimately updated to a value corresponding to the doubled concentration of purge gas. Consequently, the purge correction factor FPG becomes equal to a value that would be obtained if the purge VSV 28 were stuck in the fully open state, and highly accurate air/fuel ratio control can be achieved.

Namely, according to the routine as shown in FIG. 9, the fuel injection time TAU can be corrected so as to accurately cancel or eliminate the influence of purge gas as long as the purge VSV 28 is stuck with its opening angle being constant. Thus, the system of the present embodiment is able to achieve air/fuel ratio control with even higher accuracy than the system of the first embodiment when an open failure occurs in the purge VSV 28.

While the fixed value Y assigned to the drive duty DPG in the event of an open failure of the purge VSV 28 is set at "100" in the second embodiment as described above, the fixed value Y is not limited to "100". Namely, the system of the present embodiment is able to achieve highly accurate air/fuel ratio control even when the fixed value Y is not equal to 100, for the same reason why highly accurate air/fuel ratio control can be performed even when the purge VSV 28 is stuck in a state other than the fully open state. Thus, the fixed value Y may take an arbitrary value other than 0.

In the second embodiment as described above, a portion of the ECU 60 that executes step S234 of FIG. 9 provides "open-failure-mode opening angle setting unit" as mentioned above in "SUMMARY OF THE INVENTION". Also, in the second embodiment, the fixed value Y=100 is equivalent to "the opening angle of the purge control valve that is in a fully open state" as mentioned above.

While some embodiments of the invention have been described above, for the illustrative purpose only, it is to be understood that the invention is not limited to the details of the illustrated embodiments, but may be embodied with various changes, modifications or improvements, which may occur to those skilled in the art without departing from the spirit and scope of the invention.

What is claimed is:

1. An evaporative emission control system including a canister for collecting fuel vapor flowing from a fuel tank, comprising:

a purge control valve that controls a degree of fluid communication between the canister and an intake passage of an internal combustion engine;

a failure determining unit that determines a failure of the purge control valve;

a purging unit that executes a purging process by opening the purge control valve so that purge gas flows from the canister to the intake passage;

a fuel concentration learning unit that executes a learning process for learning a fuel concentration of the purge gas to provide a learned value of the fuel concentration;

a fuel injection amount correcting unit that executes a correcting process for correcting an amount of fuel injected into the internal combustion engine based on the learned value of the fuel concentration;

a purge condition determining unit that determines whether at least one condition for execution of purge control is satisfied;

a normal process requesting unit that requests execution of the purging process, the learning process and the correcting process when the purge control valve is normal and the at least one condition for execution of purge control is satisfied; and an open-failure-mode process requesting unit that always requests execution of the learning process and the correcting process when the failure determining unit determines that an open failure occurs in the purge control valve, the open failure being detected when the purge control valve is stuck in an open state.

2. The evaporative emission control system according to claim 1, further comprising:

a calculating method learning unit that executes a calculation method learning process for learning a calculating method of the fuel injection amount so as to provide an air/fuel ratio that is substantially equal to a target air/fuel ratio;

a normal-mode learning requesting unit that requests execution of the calculation method learning process when the purge control valve is normal and the purge control valve is in a closed state; and a close-failure-mode learning requesting unit that always requests execution of the calculation method learning process when the failure determining unit determines that a close failure occurs in the purge control valve, the close failure being detected when the purge control valve is stuck in a closed state.

3. The evaporative emission control system according to claim 2, further comprising:

a shut-off mechanism that shuts off the canister from the atmosphere when the internal combustion engine is started;

a purge control valve control unit that places the purge control valve in a closed state when the engine is started;

a pressure change calculating unit that calculates a pressure change that arises in a system including the canister over a predetermined period after the engine is started;

an open failure determining unit that determines the open failure of the purge control valve based on the pressure change;

a temperature environment sensing unit that senses a temperature environment of the fuel tank when the engine is started; and a determination permitting unit that permits determination of the open failure based on the pressure change only when the temperature environment of the fuel tank is in a low temperature range that is lower than a predetermined temperature.

4. The evaporative emission control system according to claim 2, further comprising:

a shut-off mechanism that shuts off the canister from the atmosphere when the internal combustion engine is started;

a purge control valve control unit that places the purge control valve in an open state when the engine is started;

a pressure change calculating unit that calculates a pressure change that arises in a system including the canister over a predetermined period after the engine is started;

a close failure determining unit that determines the close failure of the purge control valve based on the pressure change;

a temperature environment sensing unit that senses a temperature environment of the fuel tank when the engine is started; and a determination permitting unit that permits determination of the close failure based on the pressure change only when the temperature environment of the fuel tank is in a low temperature range that is lower than a predetermined temperature.

5. The evaporative emission control system according to claim 2, wherein:

the fuel injection amount correcting unit calculates a correction amount of the fuel injection amount based on an opening angle of the purge control valve and the learned value of the fuel concentration of the purge gas; and the fuel concentration learning unit learns the fuel concentration of the purge gas so as to provide a target air/fuel ratio when the fuel injection amount is corrected by the calculated correction amount, the evaporative emission control system further comprising:

an open-failure-mode opening angle setting unit that sets the opening angle of the purge control valve to a fixed value that is not equal to zero in the event of the open failure of the purge control valve.

6. The evaporative emission control system according to claim 5, wherein the fixed value is equivalent to an opening angle of the purge control valve that is in a fully open state.

7. The evaporative emission control system according to claim 1, wherein:

the fuel injection amount correcting unit calculates a correction amount of the fuel injection amount based on an opening angle of the purge control valve and the learned value of the fuel concentration of the purge gas; and the fuel concentration learning unit learns the fuel concentration of the purge gas so as to provide a target air/fuel ratio when the fuel injection amount is corrected by the calculated correction amount, the evaporative emission control system further comprising:

an open-failure-mode opening angle setting unit that sets the opening angle of the purge control valve to a fixed value that is not equal to zero in the event of the open failure of the purge control valve.

8. The evaporative emission control system according to claim 7, wherein the fixed value is equivalent to an opening angle of the purge control valve that is in a fully open state.

9. The evaporative emission control system according to claim 1, further comprising:

a shut-off mechanism that shuts off the canister from the atmosphere when the internal combustion engine is started;

a purge control valve control unit that places the purge control valve in a closed state when the engine is started;

a pressure change calculating unit that calculates a pressure change that arises in a system including the canister over a predetermined period after the engine is started;

an open failure determining unit that determines the open failure of the purge control valve based on the pressure change;

a temperature environment sensing unit that senses a temperature environment of the fuel tank when the engine is started; and a determination permitting unit that permits determination of the open failure based on the pressure change only when the temperature environment of the fuel tank is in a low temperature range that is lower than a predetermined temperature.

10. The evaporative emission control system according to claim 1, further comprising:

a shut-off mechanism that shuts off the canister from the atmosphere when the internal combustion engine is started;

a purge control valve control unit that places the purge control valve in an open state when the engine is started;

a pressure change calculating unit that calculates a pressure change that arises in a system including the canister over a predetermined period after the engine is started;

a close failure determining unit that determines a close failure of the purge control valve based on the pressure change, the close failure being detected when the purge control valve is stuck in a closed state;

a temperature environment sensing unit that senses a temperature environment of the fuel tank when the engine is started; and a determination permitting unit that permits determination of the close failure based on the pressure change only when the temperature environment of the fuel tank is in a low temperature range that is lower than a predetermined temperature.

11. A method of controlling an evaporative emission control system including a canister for collecting fuel vapor flowing from a fuel tank and a purge control valve for controlling a degree of fluid communication between the canister and an intake passage of an internal combustion engine, comprising the steps of:

determining a failure of the purge control valve;

executing a purging process by opening the purge control valve so that purge gas flows from the canister to the intake passage;

executing a learning process for learning a fuel concentration of the purge gas to provide a learned value of the fuel concentration;

executing a correcting process for correcting an amount of fuel injected into the internal combustion engine based on the learned value of the fuel concentration;

determining whether at least one condition for execution of purge control is satisfied;

requesting execution of the purging process, the learning process and the correcting process when the purge control valve is normal and the at least one condition for execution of purge control is satisfied; and always requesting execution of the learning process and the correcting process when it is determined that an open failure occurs in the purge control valve, the open failure being detected when the purge control valve is stuck in an open state.

12. The method according to claim 11, further comprising the steps of:

executing a calculation method learning process for learning a calculating method of the fuel injection amount so as to provide an air/fuel ratio that is substantially equal to a target air/fuel ratio;

requesting execution of the calculation method learning process when the purge control valve is normal and the purge control valve is in a closed state; and always requesting execution of the calculation method learning process when it is determined that a close failure occurs in the purge control valve, the close failure being detected when the purge control valve is stuck in a closed state.

13. The method according to claim 12, further comprising the steps of:

shutting off the canister from the atmosphere when the internal combustion engine is started;

placing the purge control valve in a closed state when the engine is started;

calculating a pressure change that arises in a system including the canister over a predetermined period after the engine is started;

determining the open failure of the purge control valve based on the pressure change;

sensing a temperature environment of the fuel tank when the engine is started; and permitting determination of the open failure based on the pressure change only when the temperature environment of the fuel tank is in a low temperature range that is lower than a predetermined temperature.

14. The method according to claim 12, further comprising the steps of:

shutting off the canister from the atmosphere when the internal combustion engine is started;

placing the purge control valve in an open state when the engine is started;

calculating a pressure change that arises in a system including the canister over a predetermined period after the engine is started;

determining the close failure of the purge control valve based on the pressure change;

sensing a temperature environment of the fuel tank when the engine is started; and permitting determination of the close failure based on the pressure change only when the temperature environment of the fuel tank is in a low temperature range that is lower than a predetermined temperature.

15. The method according to claim 12, wherein:

a correction amount of the fuel injection amount is calculated based on an opening angle of the purge control valve and the learned value of the fuel concentration of the purge gas;

the fuel concentration of the purge gas is learned so that a target air/fuel ratio is established when the fuel injection amount is corrected by the calculated correction amount; and the opening angle of the purge control valve is set to a fixed value that is not equal to zero in the event of the open failure of the purge control valve.

16. The method according to claim 15, wherein the fixed value is equivalent to an opening angle of the purge control valve that is in a fully open state.

17. The method according to claim 11, wherein:

a correction amount of the fuel injection amount is calculated based on an opening angle of the purge control valve and the learned value of the fuel concentration of the purge gas;

the fuel concentration of the purge gas is learned so that a target air/fuel ratio is established when the fuel injection amount is corrected by the calculated correction amount; and the opening angle of the purge control valve is set to a fixed value that is not equal to zero in the event of the open failure of the purge control valve.

18. The method according to claim 17, wherein the fixed value is equivalent to an opening angle of the purge control valve that is in a fully open state.

19. The method according to claim 11, further comprising the steps of:

shutting off the canister from the atmosphere when the internal combustion engine is started;

placing the purge control valve in a closed state when the engine is started;

calculating a pressure change that arises in a system including the canister over a predetermined period after the engine is started;

determining the open failure of the purge control valve based on the pressure change;

sensing a temperature environment of the fuel tank when the engine is started; and permitting determination of the open failure based on the pressure change only when the temperature environment of the fuel tank is in a low temperature range that is lower than a predetermined temperature.

20. The method according to claim 11, further comprising the steps of:

shutting off the canister from the atmosphere when the internal combustion engine is started;

placing the purge control valve in an open state when the engine is started;

calculating a pressure change that arises in a system including the canister over a predetermined period after the engine is started;

determining a close failure of the purge control valve based on the pressure change, the close failure being detected when the purge control valve is stuck in a closed state;

sensing a temperature environment of the fuel tank when the engine is started; and permitting determination of the close failure based on the pressure change only when the temperature environment of the fuel tank is in a low temperature range that is lower than a predetermined temperature.

* * * * *